US010398997B2

(12) United States Patent
Cochella

(10) Patent No.: US 10,398,997 B2
(45) **Date of Patent: *Sep. 3, 2019**

(54) TOY COUPLERS INCLUDING A PLURALITY OF BLOCK RETAINING CHANNELS

(71) Applicant: Building Creative Kids, LLC, Boulder, CO (US)

(72) Inventor: Christopher Cochella, Salt Lake City, UT (US)

(73) Assignee: Building Creative Kids, LLC, Denver, CO (US)

( * ) Notice: Subject to any disclaimer, the term of this patent is extended or adjusted under 35 U.S.C. 154(b) by 234 days.

This patent is subject to a terminal disclaimer.

(21) Appl. No.: 15/402,604

(22) Filed: Jan. 10, 2017

(65) Prior Publication Data

US 2017/0113158 A1 Apr. 27, 2017

Related U.S. Application Data

(60) Division of application No. 15/216,887, filed on Jul. 22, 2016, now Pat. No. 9,895,623, which is a (Continued)

(51) Int. Cl.

| | |
|---|---|
| ***A63H 33/00*** | (2006.01) |
| ***A63H 33/10*** | (2006.01) |
| ***A63H 33/04*** | (2006.01) |

(52) U.S. Cl.

CPC ..... *A63H 33/101* (2013.01); *A63H 33/046* (2013.01); *A63H 33/102* (2013.01)

(58) Field of Classification Search

USPC ..... 446/85, 105, 111–115, 124, 126, 128; 211/45

See application file for complete search history.

(56) References Cited

U.S. PATENT DOCUMENTS

| | | | |
|---|---|---|---|
| 1,398,852 | A | 11/1921 | Gilbert |
| 1,492,560 | A | 5/1924 | Fisher |

(Continued)

FOREIGN PATENT DOCUMENTS

| | | |
|---|---|---|
| WO | 2016/111721 | 7/2016 |
| WO | 2016131039 A1 | 8/2016 |

OTHER PUBLICATIONS

US 2014/0023288 A1, 01/2014, Mimlitch, III et al. (withdrawn)

(Continued)

*Primary Examiner* — Kurt Fernstrom

(74) *Attorney, Agent, or Firm* — James A. Sheridan; Sheridan Law, LLC

(57) ABSTRACT

Building sets including a plurality of blocks and a plurality of clips configured to engage a thickness of one or more of the blocks. Each clip includes a base and first and second substantially parallel extensions extending from the base and defining a channel therebetween into which a thickness of a block is receivable. The width of the channel is substantially equal to and slightly less than the thickness of the block receivable within the channel so that the thickness is frictionally retained therein. The clip may include a magnet enclosed within the base so that the base of a first clip may be magnetically coupled to the base of another clip, and each clip may in turn be frictionally coupled to a block received between the extensions of the respective clip. In one embodiment, the clip includes a plurality of channels.

20 Claims, 13 Drawing Sheets

Related U.S. Application Data continuation of application No. 14/962,937, filed on Dec. 8, 2015, now Pat. No. 9,399,177, which is a continuation-in-part of application No. 29/513,902, filed on Jan. 6, 2015, now Pat. No. Des. 757,860, which is a continuation-in-part of application No. 13/612,383, filed on Sep. 12, 2012, now Pat. No. 8,968,046.

(60) Provisional application No. 61/594,850, filed on Feb. 3, 2012, provisional application No. 61/546,912, filed on Oct. 13, 2011.

(56) References Cited

U.S. PATENT DOCUMENTS 2,278,327 A 3/1942 Magnus
3,747,262 A 7/1973 Endres
D230,759 S 3/1974 Hummel
3,827,177 A 8/1974 Wengel
3,955,510 A 5/1976 Kinik
3,998,002 A 12/1976 Nathanson
4,253,267 A 3/1981 Kocolowski
4,270,320 A 6/1981 Dandia
4,334,868 A 6/1982 Levinrad
4,444,321 A * 4/1984 Carlstrom ..... A47F 5/005 211/186
4,616,571 A 10/1986 Lange
5,137,486 A 8/1992 Glickman
5,175,913 A * 1/1993 Mackie ..... A63H 33/10 24/341
5,350,331 A 9/1994 Glickman
5,378,185 A 1/1995 Ban
5,487,690 A * 1/1996 Stoffle ..... A63H 33/10 16/225
5,605,486 A 2/1997 Zheng
5,729,867 A 3/1998 Carmichael
D393,417 S 4/1998 Glickman
5,746,638 A 5/1998 Shiraishi
5,827,104 A 10/1998 Zheng
5,901,859 A 5/1999 Carr et al.
D410,704 S 6/1999 Krog
5,984,756 A 11/1999 Krog
6,015,149 A 1/2000 Burk
6,059,631 A 5/2000 Maddock
6,068,533 A 5/2000 Glickman et al.
6,089,941 A 7/2000 Glickman et al.
6,186,698 B1 2/2001 Knapp
6,231,416 B1 5/2001 Clever
6,325,694 B1 12/2001 Clever
6,422,909 B2 7/2002 Clever et al.
6,592,421 B1 7/2003 Clever
6,645,032 B2 11/2003 Barringer et al.
6,648,715 B2 11/2003 Wiens et al.
6,672,931 B1 1/2004 Bagley
6,674,259 B1 1/2004 Norman et al.
6,676,474 B2 1/2004 Glickman
6,682,255 B2 1/2004 Battaglia
6,749,480 B1 6/2004 Hunts
6,843,700 B2 1/2005 Glickman
D513,471 S 1/2006 Sato
7,044,825 B2 5/2006 Glickman et al.
7,066,778 B2 6/2006 Kretzschmar
7,104,863 B2 9/2006 Mimlitch, III et al.
7,134,558 B1 11/2006 Mimlitch, III et al.
7,193,384 B1 3/2007 Norman et al.
7,201,279 B1 4/2007 Mimlitch, III et al.
7,222,684 B2 5/2007 Norman et al.
7,234,986 B2 6/2007 Kowalski et al.
7,237,404 B2 7/2007 Morano et al.
D547,977 S 8/2007 Bonatti
D550,484 S 9/2007 Bonatti
7,267,598 B2 9/2007 Glickman
7,273,404 B2 9/2007 Kowalski et al.
7,275,646 B2 10/2007 Mimlitch, III et al.
7,330,776 B1 2/2008 Norman et al.
D563,213 S 3/2008 Sato
7,364,487 B2 4/2008 Evans et al.
7,371,146 B2 5/2008 Scarborough
7,413,493 B2 8/2008 Toht et al.
7,444,792 B2 11/2008 Matson
D588,651 S 3/2009 Sinisi
7,510,457 B2 3/2009 Hussa-Lietz
7,588,476 B2 9/2009 Hammond
7,591,056 B2 9/2009 Mimlitch, III et al.
7,666,054 B2 2/2010 Glickman
7,721,396 B2 5/2010 Fleischman
7,762,386 B2 7/2010 Allore
7,806,277 B2 10/2010 Mimlitch, III et al.
7,833,078 B2 11/2010 Kretzschmar
7,866,488 B2 1/2011 Mimlitch, III et al.
7,904,706 B2 3/2011 Lambert et al.
7,934,971 B2 5/2011 Mimlitch, III et al.
7,950,978 B2 5/2011 Norman et al.
7,955,155 B2 6/2011 Tremblay et al.
D644,696 S 9/2011 Mimlitch, III et al.
D644,697 S 9/2011 Mimlitch, III et al.
D644,698 S 9/2011 Mimlitch, III et al.
D644,699 S 9/2011 Mimlitch, III et al.
D645,525 S 9/2011 Norman et al.
D645,526 S 9/2011 Norman et al.
D645,527 S 9/2011 Norman et al.
D645,914 S 9/2011 Norman et al.
D645,915 S 9/2011 Norman et al.
D645,916 S 9/2011 Norman et al.
D645,917 S 9/2011 Norman et al.
D645,918 S 9/2011 Norman et al.
8,014,897 B2 9/2011 Norman et al.
8,038,503 B2 10/2011 Norman et al.
8,099,937 B2 1/2012 Santin
D654,121 S 2/2012 Mimlitch, III et al.
D657,826 S 4/2012 Mimlitch, III et al.
D657,827 S 4/2012 Mimlitch, III et al.
D663,787 S 7/2012 Mimlitch, III et al.
D663,788 S 7/2012 Mimlitch, III et al.
D664,216 S 7/2012 Mimlitch, III et al.
D664,218 S 7/2012 Mimlitch, III et al.
D667,509 S 9/2012 Mimlitch, III et al.
D667,511 S 9/2012 Norman et al.
D667,512 S 9/2012 Mimlitch, III et al.
D667,896 S 9/2012 Mimlitch, III et al.
D667,897 S 9/2012 Mimlitch, III et al.
D668,300 S 10/2012 Mimlitch, III et al.
D668,301 S 10/2012 Mimlitch, III et al.
D668,457 S 10/2012 Mimlitch, III et al.
D669,140 S 10/2012 Mimlitch, III et al.
D669,942 S 10/2012 Mimlitch, III et al.
D669,943 S 10/2012 Mimlitch, III et al.
D669,944 S 10/2012 Mimlitch, III et al.
8,292,687 B2 10/2012 Tremblay et al.
D670,769 S 11/2012 Mimlitch, III et al.
D670,770 S 11/2012 Mimlitch, III et al.
8,303,366 B2 11/2012 Tremblay et al.
D671,993 S 12/2012 Mimlitch, III et al.
8,337,270 B2 12/2012 Mimlitch, III et al.
D675,264 S 1/2013 Mimlitch, III et al.
D675,265 S 1/2013 Mimlitch, III et al.
D676,496 S 2/2013 Mimlitch, III et al.
D676,497 S 2/2013 Mimlitch, III et al.
D676,505 S 2/2013 Mimlitch, III et al.
D676,506 S 2/2013 Mimlitch, III et al.
D676,507 S 2/2013 Mimlitch, III et al.
D677,347 S 3/2013 Mimlitch, III et al.
D677,740 S 3/2013 Mimlitch, III et al.
D677,742 S 3/2013 Mimlitch, III et al.
D678,428 S 3/2013 Mimlitch, III et al.
D679,763 S 4/2013 Mimlitch, III et al.
D682,368 S 5/2013 Mimlitch, III et al.
D682,953 S 5/2013 Mimlitch, III et al.
D683,411 S 5/2013 Mimlitch, III et al.
D684,218 S 6/2013 Mimlitch, III et al.
D684,221 S 6/2013 Mimlitch, III et al.
8,475,225 B2 7/2013 Kretzschmar
D687,903 S 8/2013 Mimlitch, III et al.

(56) References Cited

U.S. PATENT DOCUMENTS 8,504,200 B2 8/2013 Norman et al.
8,505,086 B2 8/2013 Norman et al.
D689,141 S 9/2013 Mimlitch, III et al.
D689,142 S 9/2013 Mimlitch, III et al.
D689,143 S 9/2013 Mimlitch, III et al.
D689,144 S 9/2013 Mimlitch, III et al.
D689,145 S 9/2013 Mimlitch, III et al.
D689,146 S 9/2013 Mimlitch, III et al.
D689,147 S 9/2013 Mimlitch, III et al.
D689,148 S 9/2013 Mimlitch, III et al.
D689,149 S 9/2013 Mimlitch, III et al.
D689,150 S 9/2013 Mimlitch, III et al.
D689,151 S 9/2013 Mimlitch, III et al.
D689,152 S 9/2013 Mimlitch, III et al.
D689,561 S 9/2013 Mimlitch, III et al.
D689,562 S 9/2013 Mimlitch, III et al.
D689,563 S 9/2013 Mimlitch, III et al.
D689,564 S 9/2013 Mimlitch, III et al.
D689,565 S 9/2013 Mimlitch, III et al.
D689,959 S 9/2013 Mimlitch, III et al.
D689,960 S 9/2013 Mimlitch, III et al.
D689,961 S 9/2013 Mimlitch, III et al.
D689,962 S 9/2013 Mimlitch, III et al.
D689,964 S 9/2013 Mimlitch, III et al.
8,529,311 B2 9/2013 Tremblay et al.
D692,070 S 10/2013 Mimlitch, III et al.
8,550,235 B2 10/2013 Suderman
D692,965 S 11/2013 Mimlitch, III et al.
D693,889 S 11/2013 Mimlitch, III et al.
D694,344 S 11/2013 Mimlitch, III et al.
D694,345 S 11/2013 Mimlitch, III et al.
8,591,281 B2 11/2013 Mimlitch, III et al.
D694,840 S 12/2013 Mimlitch, III et al.
D695,362 S 12/2013 Mimlitch, III et al.
D696,732 S 12/2013 Mimlitch, III et al.
D696,733 S 12/2013 Mimlitch, III et al.
8,612,051 B2 12/2013 Norman et al.
8,616,463 B2 12/2013 Mimlitch, III et al.
D697,147 S 1/2014 Mimlitch, III et al.
D698,395 S 1/2014 Norman et al.
D699,302 S 2/2014 Mimlitch, III et al.
D700,251 S 2/2014 Mimlitch, III et al.
8,651,914 B2 2/2014 Sisamos
D700,661 S 3/2014 Mimlitch, III et al.
D702,776 S 4/2014 Norman et al.
D703,767 S 4/2014 Mimlitch, III et al.
8,696,399 B2 4/2014 Mimlitch et al.
D705,874 S 5/2014 Norman et al.
8,721,384 B2 5/2014 Norman et al.
D706,362 S 6/2014 Norman et al.
D706,363 S 6/2014 Norman et al.
D706,877 S 6/2014 Norman et al.
D707,276 S 6/2014 Norman et al.
D707,304 S 6/2014 Norman et al.
D707,305 S 6/2014 Norman et al.
D707,306 S 6/2014 Norman et al.
D707,757 S 6/2014 Mimlitch, III et al.
D707,758 S 6/2014 Norman et al.
D708,680 S 7/2014 Norman et al.
D711,972 S 8/2014 Norman et al.
D711,973 S 8/2014 Norman et al.
D711,974 S 8/2014 Norman et al.
D711,975 S 8/2014 Norman et al.
D711,976 S 8/2014 Norman et al.
D711,977 S 8/2014 Norman et al.
D711,978 S 8/2014 Norman et al.
D711,979 S 8/2014 Norman et al.
D711,980 S 8/2014 Norman et al.
D711,981 S 8/2014 Norman et al.
8,810,387 B2 8/2014 Norman et al.
D712,489 S 9/2014 Norman et al.
8,834,226 B2 9/2014 Norman et al.
8,834,227 B2 9/2014 Norman et al.
D715,871 S 10/2014 Norman et al.
D715,873 S 10/2014 Norman et al.
D715,874 S 10/2014 Norman et al.
D716,384 S 10/2014 Norman et al.
8,858,294 B2 10/2014 Mimlitch, III et al.
D716,879 S 11/2014 Norman et al.
D717,380 S 11/2014 Mimlitch, III et al.
D717,886 S 11/2014 Mimlitch, III et al.
8,882,558 B2 11/2014 Norman et al.
D720,419 S 12/2014 Norman et al.
8,905,813 B2 12/2014 Norman et al.
8,913,393 B2 12/2014 Mimlitch, III et al.
8,913,398 B2 12/2014 Mimlitch, III et al.
D720,823 S 1/2015 Norman et al.
D720,824 S 1/2015 Norman et al.
D720,825 S 1/2015 Norman et al.
D722,665 S 2/2015 Norman et al.
D723,123 S 2/2015 Norman et al.
D724,028 S 3/2015 Norman et al.
D725,037 S 3/2015 Norman et al.
D725,733 S 3/2015 Norman et al.
8,968,046 B2 3/2015 Cochella
9,004,974 B2 4/2015 Brooks
9,017,136 B2 4/2015 Norman et al.
D731,449 S 6/2015 Norman et al.
9,050,540 B1 6/2015 Norman et al.
9,050,541 B2 6/2015 Mimlitch, III et al.
D733,530 S 7/2015 Tonthat et al.
D733,531 S 7/2015 Tonthat et al.
D740,368 S 10/2015 Norman et al.
9,149,731 B2 10/2015 Mimlitch, III et al.
9,162,153 B1 10/2015 Mimlitch, III et al.
9,162,154 B2 10/2015 Mimlitch, III et al.
D747,688 S 1/2016 Norman et al.
D747,776 S 1/2016 Norman et al.
9,233,313 B2 1/2016 Olivera et al.
9,238,178 B2 1/2016 Mimlitch, III et al.
D750,177 S 2/2016 Norman et al.
D752,518 S 3/2016 Norman et al.
9,289,694 B2 3/2016 Norman et al.
D757,860 S 5/2016 Cochella
D758,225 S 6/2016 Norman et al.
D759,466 S 6/2016 Tonthat et al.
9,360,052 B2 6/2016 Culver et al.
9,370,119 B2 6/2016 Tonthat et al.
9,370,724 B2 6/2016 Norman et al.
D760,579 S 7/2016 Tonthat et al.
9,399,177 B2 7/2016 Cochella
2002/0104942 A1 8/2002 Mimlitch, III et al.
2002/0121395 A1 9/2002 Norman et al.
2003/0175669 A1 9/2003 Mimlitch, III et al.
2003/0176142 A1 9/2003 Mimlitch, III et al.
2004/0077257 A1 4/2004 Mimlitch, III et al.
2006/0129846 A1 6/2006 Lambert et al.
2007/0131628 A1 6/2007 Mimlitch, III et al.
2007/0135017 A1 6/2007 Norman et al.
2007/0227992 A1 10/2007 Mimlitch, III et al.
2008/0100250 A1 5/2008 Norman et al.
2008/0175659 A1 7/2008 Mimlitch et al.
2008/0220689 A1 9/2008 Mimlitch et al.
2008/0263628 A1 10/2008 Norman et al.
2008/0269949 A1 10/2008 Norman et al.
2009/0218301 A1 9/2009 Mimlitch, III et al.
2010/0242250 A1 9/2010 Haughey et al.
2011/0028069 A1 2/2011 Norman et al.
2011/0076914 A1 3/2011 Norman et al.
2011/0076916 A1 3/2011 Norman et al.
2011/0076917 A1 3/2011 Norman et al.
2011/0076918 A1 3/2011 Norman et al.
2011/0111671 A1 5/2011 Norman et al.
2011/0117814 A1 5/2011 Norman et al.
2011/0151742 A1 6/2011 Mimlitch, III et al.
2012/0015585 A1 1/2012 Norman et al.
2012/0029695 A1 2/2012 Norman et al.
2012/0034839 A1 2/2012 Murphy
2012/0080533 A1 4/2012 Mimlitch, III et al.
2012/0178339 A1 7/2012 Mimlitch, III et al.
2012/0178340 A1 7/2012 Mimlitch, III et al.
2012/0264341 A1 10/2012 Mimlitch, III et al.
2012/0302127 A1 11/2012 Doskas
2013/0084771 A1 4/2013 Mimlitch, III et al.

(56) References Cited

U.S. PATENT DOCUMENTS

| | | | |
|---|---|---|---|
| 2013/0084773 | A1 | 4/2013 | Mimlitch, III et al. |
| 2013/0084774 | A1 | 4/2013 | Mimlitch, III et al. |
| 2013/0084775 | A1 | 4/2013 | Mimlitch, III et al. |
| 2013/0090037 | A1 | 4/2013 | Mimlitch, III et al. |
| 2013/0091689 | A1 | 4/2013 | Mimlitch, III et al. |
| 2013/0095722 | A1 | 4/2013 | Cochella |
| 2013/0149935 | A1 | 6/2013 | Mimlitch, III et al. |
| 2013/0171910 | A1 | 7/2013 | Mimlitch, III et al. |
| 2013/0267145 | A1 | 10/2013 | Rosen et al. |
| 2014/0045403 | A1 | 2/2014 | Murphy |
| 2014/0057525 | A1 | 2/2014 | Olivera et al. |
| 2014/0094088 | A1 | 4/2014 | Olivera et al. |
| 2015/0084494 | A1 | 3/2015 | Tonthat et al. |
| 2015/0165331 | A1 | 6/2015 | Norman et al. |
| 2015/0219164 | A1 | 8/2015 | Culver et al. |
| 2015/0224413 | A1 | 8/2015 | Mimlitch, III et al. |
| 2015/0224415 | A1 | 8/2015 | Brooks |
| 2015/0306510 | A1 | 10/2015 | Mimlitch, III et al. |
| 2015/0306511 | A1 | 10/2015 | Norman et al. |
| 2015/0306514 | A1 | 10/2015 | Mimlitch, III et al. |
| 2016/0009348 | A1 | 1/2016 | Mimlitch, III et al. |
| 2017/0007938 | A1 | 1/2017 | Brooks |
| 2017/0113158 | A1 | 4/2017 | Cochella |
| 2017/0120158 | A1 | 5/2017 | Cochella |
| 2017/0120159 | A1 | 5/2017 | Cochella |

OTHER PUBLICATIONS

Photographs of prototype product seen at MindWare booth at Toy Fair 2015 (in New York City), based on information and belief, photographed Feb. 17, 2015 (2 photographs).

Product Brochure for Keva Maker Bot Maze, based on information and belief, provided to applicant on or about Jul. 20, 2015 (1 page).

"Locktagons" in Patch Products 2010 Catalog, 2 pages.

"Dollhouse Designer" by Lakeshore, Accessed Nov. 1, 2016, 4 pages, Available at www.lakeshorelearning.com/product/productDet.jsp?productItemID=1%2C689%2C949%2C371%2C931%2C428&ASSORTMENT%3CEast_id=1408474395181113&bmUID=1495141244451.

Photos of "Locktagons" product packaging and Product Insert, by Patch Products, LLC, Purchased and photographed in spring 2017, Copyright date of 2015, 5 pages.

Wikipedia "Lego" Accessed May 19, 2016, 10 pages, "https://en.wikipedia.org/w/index.php?title=lego&oldid=720051184".

Wikipedia "Mortise and Tenon" Accessed May 19, 2016, 5 pages "https://en.wikipedia.org/w/index.php?title=Mortise_and_tenod&oldid=713513834".

"Tinkertoy" Wikipedia, the free encyclopedia, accessed Aug. 15, 2016 at https://en.wikipedia.org/wiki/Tinkertoy, 3 pages.

International Search Report and Written Opinion for PCT/US2015/039226 dated Sep. 29, 2015, 12 pp.

Restriction Requirement for U.S. Appl. No. 13/612,383 dated May 5, 2014, 5 pp.

Non-Final Office Action for U.S. Appl. No. 13/612,383 dated Aug. 7, 2014, 5 pp.

Notice of Allowance for U.S. Appl. No. 13/612,383, dated Dec. 31, 2014, 5 pp.

Notice of Allowance for U.S. Appl. No. 29/513,902, dated Jan. 22, 2016, 10 pp.

Non-Final Office Action for U.S. Appl. No. 14/962,937, dated Mar. 15, 2016, 5 pp.

Notice of Allowance for U.S. Appl. No. 14/962,937, dated May 23, 2016, 5 pp.

* cited by examiner

TOY COUPLERS INCLUDING A PLURALITY OF BLOCK RETAINING CHANNELS

CROSS-REFERENCE TO RELATED APPLICATIONS

This application is a divisional application of U.S. patent application Ser. No. 15/216,887, filed Jul. 22, 2016 by Christopher Cochella for "TOY COUPLERS INCLUDING A PLURALITY OF BLOCK RETAINING CHANNELS," which patent application is a continuation of U.S. patent application Ser. No. 14/962,937, filed on Dec. 8, 2015 by Christopher Cochella for "TOY COUPLERS INCLUDING A PLURALITY OF BLOCK RETAINING CHANNELS," which patent application issued as U.S. Pat. No. 9,399,177 on Jul. 26, 2016 and which patent application is a continuation-in-part of U.S. Design Patent Application No. 29/513,902, filed Jan. 6, 2015 by Christopher Cochella for "TOY COUPLER," which patent application issued as Design Pat. No. D757,860 on May 31, 2016 and which patent application is a continuation-in-part of U.S. patent application Ser. No. 13/612,383, filed Sep. 12, 2012 by Christopher Cochella for "TOY COUPLERS INCLUDING A PLURALITY OF BLOCK RETAINING CHANNELS," which patent application issued as U.S. Pat. No. 8,968,046 on Mar. 3, 2016 and which patent application claims the benefit under 35 U.S.C. 119(e) of U.S. Provisional Patent Application No. 61/546,912, filed Oct. 13, 2011 by Christopher Cochella for "BUILDING SETS INCLUDING BLOCKS AND MAGNETIC COUPLING TIPS" and U.S. Provisional Patent Application No. 61/594,850, filed Feb. 3, 2012 by Christopher Cochella for "TOY COUPLERS INCLUDING A PLURALITY OF BLOCK RETAINING CHANNELS," all of which patent applications are hereby incorporated herein by reference.

BACKGROUND OF THE INVENTION

1. The Field of the Invention

The present invention relates to toy building sets, particularly building sets including a plurality of blocks to be indirectly magnetically and/or frictionally coupled together.

2. The Relevant Technology

Various building sets have been used by children and others for decades for amusement and learning. Sets of blocks include a plurality of variously configured blocks that allow a user to stack the blocks on top of one another in order to form various structures or buildings. Stacking configurations that can be achieved are often limited as a result of gravity.

Other building sets have provided magnets sealed within blocks (e.g., U.S. Publication No. 2010/0242250), and multi-shaped non-metallic bodies employing disc shaped magnets so that two adjacent bodies may be magnetically connected together (e.g., U.S. Pat. Nos. 6,749,480 and 5,746,638). U.S. Pat. No. 7,413,493 describes toy magnetic building blocks including a block, a casing affixed to the block, and a magnet within the casing. The magnet allows connections to be made with other similar blocks. As shown in FIG. 10, one embodiment may also include connectors with a collar to mechanically augment magnetic coupling of the blocks, in which narrowed ends of each block are received within opposite halves of the collar.

Such building systems are severely limited in their ability to build relatively realistic building structures such as those employing post and beam construction in which elongate blocks can be secured to one another in an erector like configuration, but in which connections can be more easily achieved (e.g., by a child between about 4 to about 8). As such, even with existing magnetic building systems, there remain difficulties to be overcome.

BRIEF DESCRIPTION OF THE DRAWINGS

To further clarify the above a more particular description of the disclosure will be rendered by reference to specific examples that are illustrated in the appended drawings. It is appreciated that these drawings depict only typical examples and are therefore not to be considered limiting. The examples will be described and explained with additional specificity and detail through the use of the accompanying drawings in which.

Together with the following description, the figures demonstrate non-limiting features of exemplary devices and methods. The same reference numerals in different drawings represent similar, though not necessarily identical, elements.

DETAILED DESCRIPTION OF THE PREFERRED EMBODIMENTS

The present invention is directed to building sets including a plurality of blocks and a plurality of clips configured to frictionally engage one or more of the blocks. The clips include a magnet enclosed within the clip, which facilitates coupling of various blocks (e.g., elongate "post" and "beam" type blocks) together (with a clip in between) in various configurations not possible when stacking blocks alone (e.g., arches, bridges, trusses, eaves, girders, posts, beams, and other structures and buildings) as a result of the strength of the magnetic coupling. The system allows connection of non-magnetic bodies (i.e., the blocks) into simulated life-like structures such as those noted above through the use of magnetically coupling clips that frictionally engage the blocks. In addition, because the connection between the block and clip is friction based, a high degree of freedom is available in placement of the clips (e.g., anywhere along a side, end, or face of a block, as the case may be for a given clip).

Figure 1:
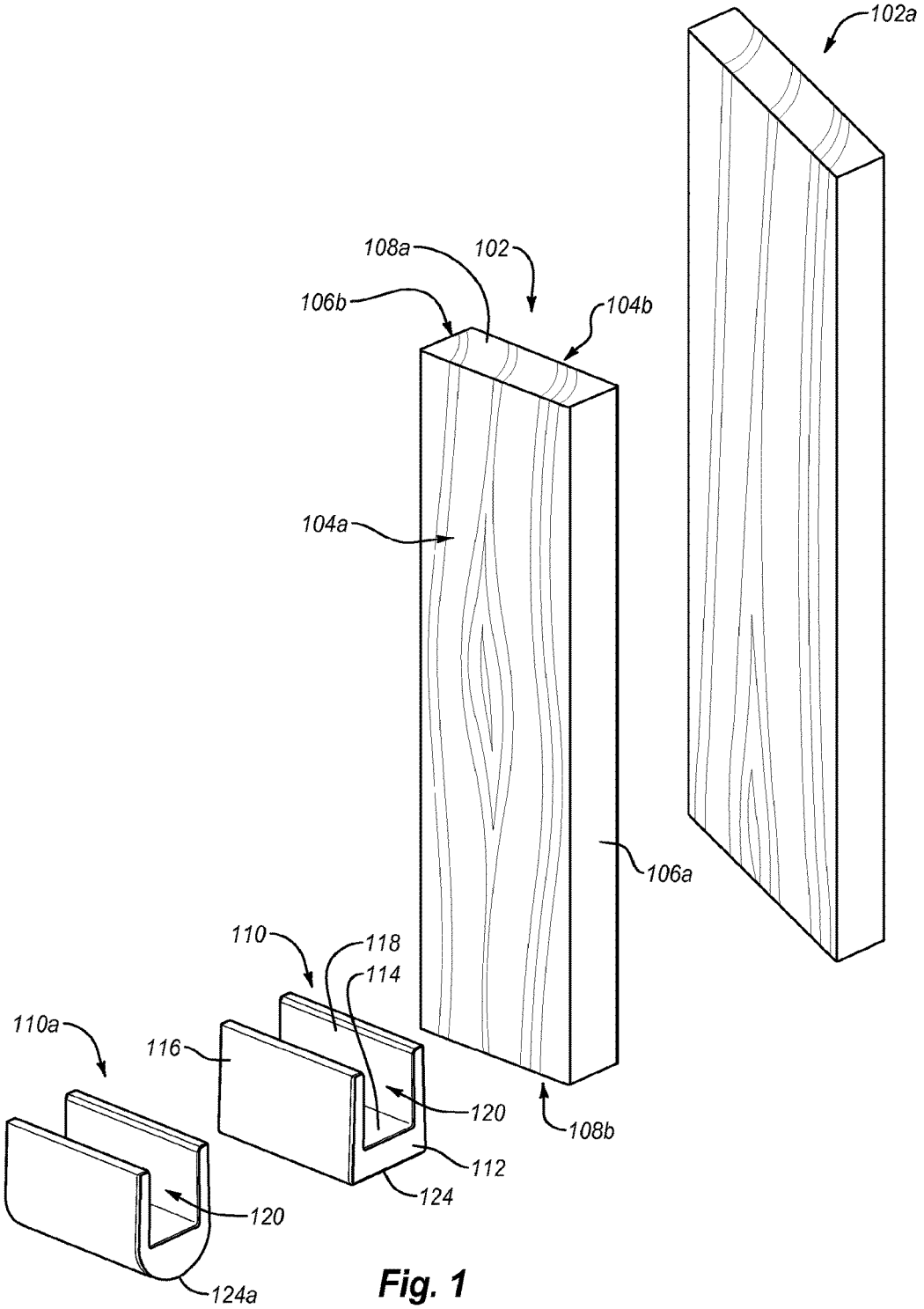
FIG. 1 illustrates an exemplary building set including a plurality of blocks and a plurality of magnetic coupling clips configured to frictionally engage a thickness of one or more of the blocks.
Figure 4A:
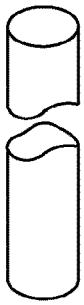
FIGS. 4A-4C are perspective views of cylindrical, square, and specialized decorative block configurations, respectively.
Figure 4B:
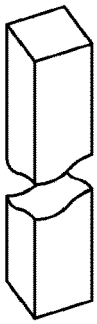
Figure 4C:
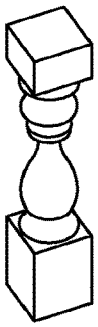

As shown in FIG. 1, each block 102 of building set 100 may typically include a first face 104*a*, an opposing second face 104*b*, a first side 106*a*, an opposed second side 106*b*, a first end 108*a*, and an opposed second end 108*b*. Block 102 is shown as elongate, (i.e., a plank, post, or beam). In one embodiment, an exemplary elongate block may be about 120 mm long, about 25 mm wide, and about 8 mm thick. In one embodiment, the aspect ratio of length to width may be from about 3 to about 7 (e.g., about 5). In one embodiment, the aspect ratio of length to thickness may be from about 10 to about 20 (e.g., about 15). The thickness engaged by the clip 110 may be between about 5 and about 10 mm. Of course, blocks other than elongate blocks may be included within the plurality of blocks in the building set, although in one embodiment, at least some of the included blocks will be elongate (i.e., of the plank, post, beam variety). Of course, more complex block configurations are possible, including decorative features (e.g., as seen in FIG. 4C), as are blocks including rounded surfaces (e.g., as seen in FIG. 4A) where boundaries between faces, sides, or ends may not be discrete. In any case, such blocks are three dimensional, having thicknesses in x, y, and z dimensions.

The building set 100 further includes a plurality of clips 110 configured to engage a thickness of one or more of the blocks. In one embodiment, the clip might engage a thickness of multiple blocks stacked together. Exemplary clip 110 may include a base 112 including a floor 114 against which a surface of a block may be inserted during frictional engagement, and first and second extensions 116, 118 extending upwardly from base 112. Extensions 116, 118 define a channel 120 therebetween and which may be open at a top end adjacent top ends of extensions 116, 118. Channel 120 may also be open at either end, adjacent lateral ends of extensions 116, 118, and floor 114. Channel 120 advantageously has a width that is substantially equal (and slightly less than) the thickness of the block that is receivable and to be frictionally retained within channel 120. For example, the thickness between faces 104*a* and 104*b* of illustrated block 102 may be substantially equal to the width of channel 120, between extensions 116, 118 so that the extensions may frictionally retain block 102 when inserted into channel 120. In another embodiment, a clip may be configured with a width of channel 120 that is substantially equal to the thickness between first and second sides 106*a* and 106*b* (i.e., to straddle this wider dimension of rectangular block 102).

In addition, it will be readily apparent that clip 110 may be positioned in a variety of locations along side 106*a*, 106*b*, or ends 108*a*, 108*b* to straddle the thickness between faces 104*a* and 104*b*. In other words, attachment of clip 110 to block 102 is not limited to only a single, or even a small number of locations, but may be slid to an infinite number of positions anywhere along sides 106*a*, 106*b*, or ends 108*a*, 108*b*. This characteristic provides an increased freedom in building that is not possible with fixed connection systems, in which connection is only possible at a single (or small number of) predetermined location(s).

In addition to the frictional retaining engagement provided by extensions 116 and 118 of clip 110, clip 110 further includes a magnet enclosed therein (e.g., within base 112) so that base 112 of clip 110 may be coupled to the base of another clip when the enclosed magnets are positioned close to one another. Of course, a magnet may be enclosed elsewhere within clip (e.g., within one or more of extensions 116, 118) to provide magnetic coupling between any portion of two clips including encased magnets. This frictional engagement and magnetic engagement configuration allows blocks to be stacked or positioned adjacent to one another, typically with clips disposed in between, providing a much more robust connection between the blocks than is possible with simple stacking.

For example, blocks may be cantilevered much like a house of cards, while clips positioned in between individual blocks provide a much stronger connection throughout the entire structure. For example, it may be possible to lift such a structure off a floor or other supporting surface, while it maintains its structural integrity. In order to provide even better structural integrity, the building structure may include clips frictionally engaged on blocks at the bottom of the structure, adjacent the floor or other supporting surface, while the supporting surface comprises a magnetically attractable pad or building surface to which the clips (and thus the super-structure thereabove) are strongly magnetically coupled.

Figure 2A:
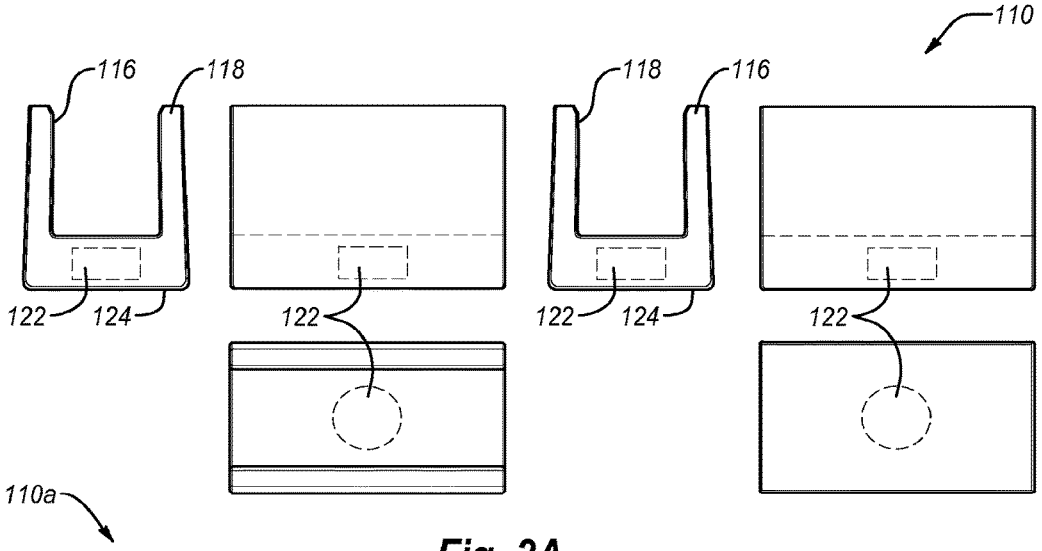
FIG. 2A includes various views of an exemplary magnetic clip including a magnet within the clip base and a channel configured to frictionally engage a thickness of a block.
Figure 2B:
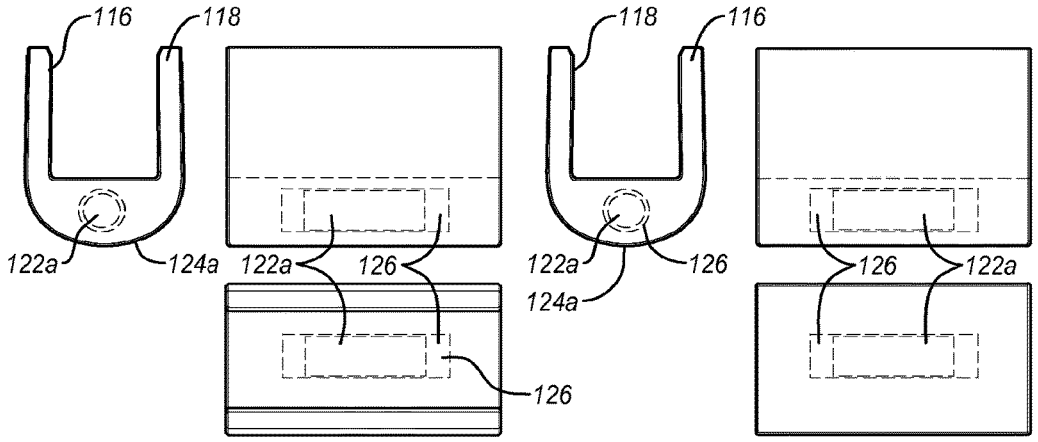
FIG. 2B includes various views of another exemplary magnetic clip.

Also shown in FIG. 1 is another block 102*a* having a thickness dimension between opposed faces that is the same as block 102, and which could therefore also be engaged within channel 120 of clip 110. Another configuration of a clip 110*a* similar to clip 110 is also shown in FIG. 1, the principal difference being that bottom 124*a* of the base of clip 102*a* is rounded, rather than being substantially flat, as is bottom 124 of base 112 of clip 110. This configuration allows clip 110*a* to magnetically couple to clip 110 (or another clip 110*a*) at any desired angle between respective clip channels. In other words, the rounded bottom 124*a* of clip 110*a* can be rotated against bottom 124 of clip 110 to a desired angle. Blocks may be frictionally engaged within channels 120 of one or more clips 110, 110*a*. FIG. 2A shows 6 views of clip 110 (4 elevation views as well as top and bottom views), while FIG. 2B shows the same views of clip 110*a*. Other rounded or angled configurations to the clip bottom surfaces (or surfaces of extensions) are also possible (e.g., rounding outer surfaces of extensions 116, 118, providing an angled surface to bottom 124, etc.).

As described, each clip includes a magnet 122 encased within base 112 of clip 110, 110*a*. Besides the difference in the configuration of exterior bottom surface 124, FIGS. 2A-2B also show alternative magnet configurations. Referring to clip 110 of FIG. 2A, magnet 122 may be a generally cylindrical shaped magnet having a relatively short height to the cylinder, and which is oriented with the height axis of the cylinder generally parallel to the extensions 116, 118. Such a shape may resemble a hockey puck. A pocket may be formed within base 112 that is slightly larger than magnet 122 so as to allow magnet 122 to rotate about its height axis. In another embodiment, magnet 122 may be fixed relative to base 122, so that no rotation occurs.

Figure 2C:
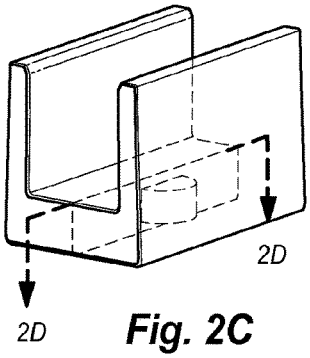
FIGS. 2C-2D include perspective and cross-sectional views through clips similar to those of FIGS. 2A-2B.
Figure 2D:
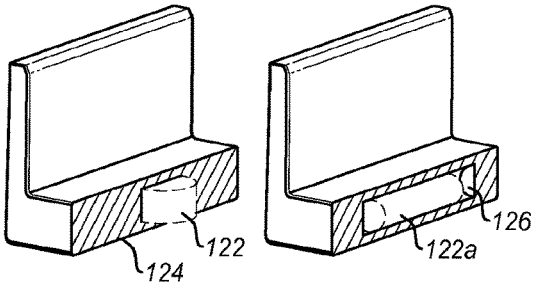

As shown in FIG. 2B another configuration may include a generally cylindrical shaped magnet with a greater height dimension (i.e., greater height to diameter ratio), while the magnet may also be oriented differently, so that the height axis of magnet 122*a* is generally parallel to a longitudinal axis of the clip (e.g., resembling a rolling pin). In other words, the height axis of magnet 122*a* may be generally perpendicular to extensions 116, 118. In the illustrated configuration, pocket 126 is oversized relative to magnet 122*a*, so as to allow magnet 122 to rotate about its height axis, and perhaps even slide somewhat in the height direction of the cylinder. Puck shaped magnet 122 may sometimes commonly be referred to as a disc magnet, while rolling-pin shaped magnet 122*a* may commonly be referred to as a cylindrical magnet. A disc magnet may have a N and S on opposite surfaces of the disc. An alternative configuration may employ square or rectangular shaped magnets. In one embodiment, cylindrical magnets may be magnetized on the long axis of the cylinder. This may allow the magnet to pivot and rotate. Discs and similar shapes can magnetically couple along their edges. Of course any magnet configuration may be employed with any clip configuration (e.g., a "rolling pin" in an oversized pocket configuration may be used with a clip 110 including a planar exterior surface). FIGS. 2C and 2D show cut away views of the embodiment shown in FIG. 2A. FIG. 2D also shows a cut away view of an embodiment similar to that shown in FIG. 2A but with a "rolling pin" shaped magnet as in FIG. 2B.

Strongly magnetic rare earth neodymium and/or samarium-cobalt magnets are particularly preferred, although other types of magnets (e.g., AlNiCo magnets, ceramic magnets, and/or ferrite magnets) may also be used. Permanent magnets are preferred.

Figure 3A:
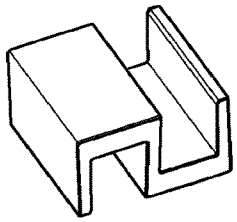
FIGS. 3A-3C are perspective views of various magnetic clips including two channels, each for engaging a thickness of a block.
Figure 3B:
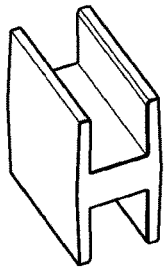
Figure 3C:
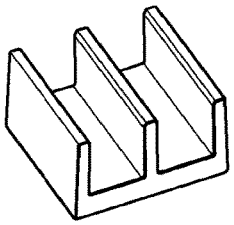

FIGS. 3A-3C show various clip configurations including two channels, although other two-channel configurations are also possible. The embodiment of FIG. 3A resembles two clips positioned with extensions adjacent to one another, and the orientation of the channels oriented 180° relative to one another. The embodiment of FIG. 3B resembles two clips positioned with the bottom surfaces of bases positioned adjacent to one another, with channels are oriented 180° relative to one another. The embodiment of FIG. 3C resembles two clips with the face surfaces of extensions positioned adjacent to one another and with the orientation of the channels aligned, to be parallel to, and next to, one another. Of course, such configurations could be made with two separate clips such as seen in FIG. 2A, or could be molded or otherwise formed (e.g., machined) as an integral piece, as seen in FIGS. 3A-3C. The illustrated clip includes a U or C shaped channel. Other embodiments may include channels or clip bodies that are angled, L shaped, T shaped, include any number (e.g., 3, 5, 7, etc.) radial connections. FIGS. 3A and 3C illustrate two channel configurations, although similar configurations including 3 or more channels could also be provided.

Figure 3D:
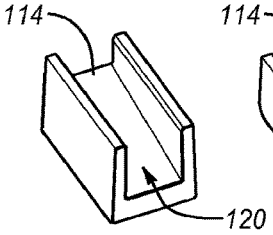
FIGS. 3D-3E are perspective views of clips similar to those shown in FIG. 1 but each including an inclined floor surface.
Figure 3E:
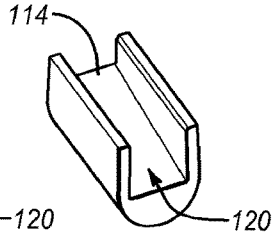

FIGS. 3D and 3E show clips similar to the two configurations seen in FIG. 1, but in which the floor 114 of each is inclined towards one end of open channel 120. Such a clip may be magnetically coupled to a clip as shown in FIG. 1 in a configuration similar to that seen in any of FIGS. 3A-3C (e.g., as in FIG. 3B) to provide an angled relationship (e.g., greater than or less than 180°) between a block received within the channels of each clip. For example, the angle of the incline may be greater than 0 and less than 90°, between about 10° and about 80°, or between about 30° and about 60°, e.g., about 45°)

Figure 3F:
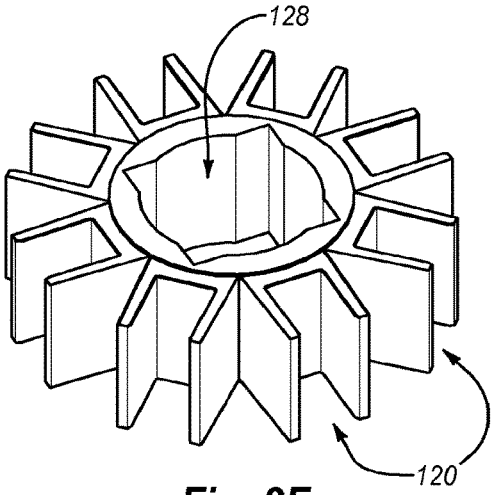
FIG. 3F is a perspective view of a clip including a plurality of channels arranged about a central body or sleeve in a "star" type configuration.

FIG. 3F illustrates a star-like clip configuration resembling 8 clips positioned around a central sleeve or central body. The clip of FIG. 3F includes 8 channels 120, while the central sleeve or body also includes center sleeve or hole 128 which is aligned with a central longitudinal axis of the clip of FIG. 3F. Sleeve 128 may be open at both ends, or closed at a bottom end and open at only one end. Sleeve 128 may be sized to receive both a face-to-face thickness of a block as well as a side-to-side thickness of a block simultaneously. The sleeve or hole may be cylindrical to receive a cylindrical block, it may be rectangular to receive a rectangular block, or it may be as shown, including both rectangular and cylindrical features to be capable of receiving either. Where the bottom of sleeve or hole 128 is closed, a magnet may be disposed at the bottom of this closed bottom.

Although a particular configuration of a star-like clip is shown in FIG. 3F, it will be understood that other similar configurations are also possible. For example, more or less than 8 channels could be included (e.g., 2, 3, 4, 5, 6, 7, 9, 10, etc.). In addition, they may be equally distributed about the central body, so angles therebetween are equal, or they may not be equally distributed, so angles therebetween are not all equal. In another embodiment, no central sleeve or hole may be present, but rather simply a solid body (i.e., as if hole 128 were filled).

Figure 3G:
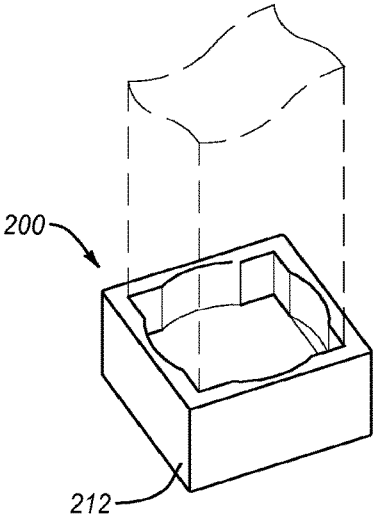
FIGS. 3G-3I are perspective views of clips configured to receive an end of a cylindrical block, as well as a rectangular or square cross-section block.
Figure 3H:
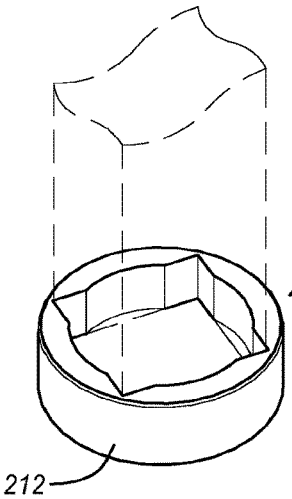
Figure 3I:
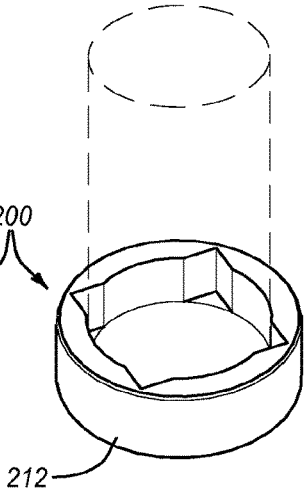

FIGS. 3G-3I illustrate clips that are configured to receive both a face-to-face and a side-to-side thickness of a block, which may be rectangular in cross-section or may be cylindrical (i.e., circular in cross-section). Other configurations will also be apparent to one of skill in the art in light of the present disclosure—e.g., a clip with an oval hole for receiving a block having an oval cross-section. Magnets may be disposed within the peripheral edges of body 212 of clip 200. Where clip 200 is closed at the bottom rather than being an open sleeve, a magnet may be disposed within the body adjacent the closed bottom surface.

Figure 3J:
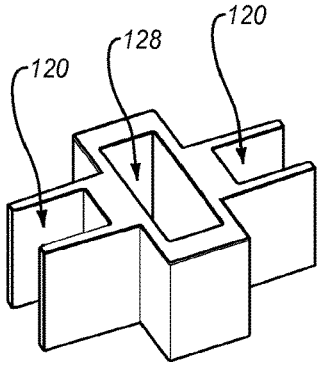
FIGS. 3J-3O are perspective views of various clips including a central sleeve for slidable reception of a block and further including a plurality of channels arranged about the central sleeve for receiving and retaining a thickness of additional blocks.

FIGS. 3J-3O illustrate additional various relatively complex contemplated clip configurations including an optional sleeve or hole 128 (where a bottom of the hole is closed) and one or more channels 120 for retaining a thickness of a block. As shown, the various channels 120 may be arranged in any orientation relative to each other. FIG. 3J shows a clip including two channels 120 on opposite sides of a central sleeve or hole 128, with the axis of the channels 120 parallel to one another and to the sleeve or hole (i.e., all 3 coparallel to one another). For example, in the illustrated orientation all channels and sleeve/hole are configured to receive block members in a substantially vertical orientation.

Figure 3K:
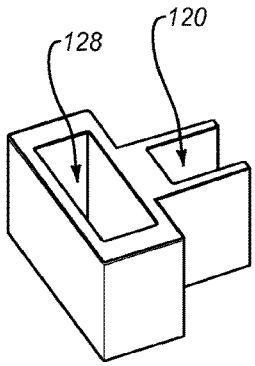

FIG. 3K shows another example with only a single channel 120, otherwise similar to the configuration of FIG.

Figure 3L:
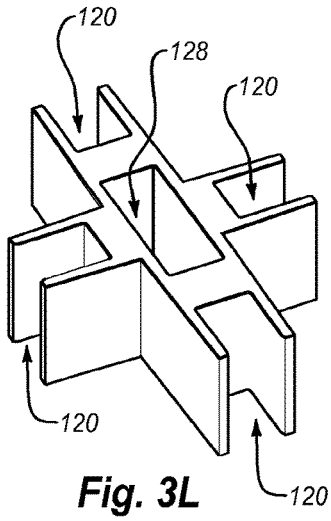
Figure 3M:
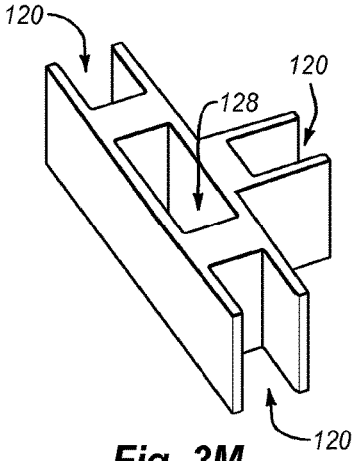
Figure 3N:
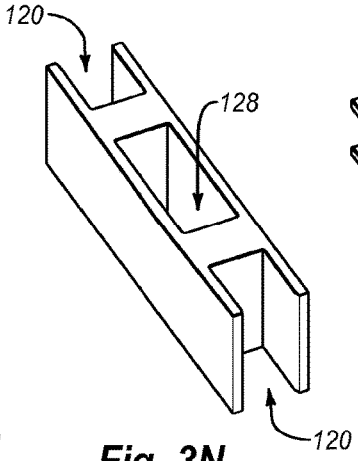
Figure 3O:
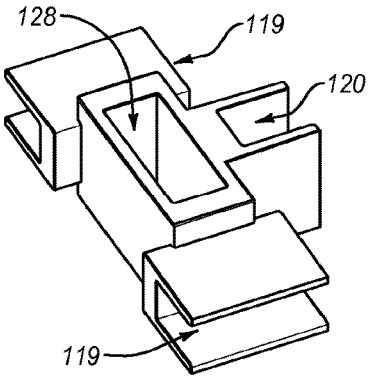

3J. FIG. 3L shows an example with 4 channels, similar to that of FIG. 3J, but with additional channels 120 at either side of sleeve or hole 128. FIGS. 3M and 3N show additional variations of such clip configurations. In FIG. 3O, clip channels 119 are shown oriented transverse to clip channels 120, so that if clip channel 120 secures a block in a vertical orientation, clip channels 119 may be used to secure blocks in horizontal orientations. Various additional configurations will be apparent to one of skill in the art in light of the present disclosure.

Figure 3P:
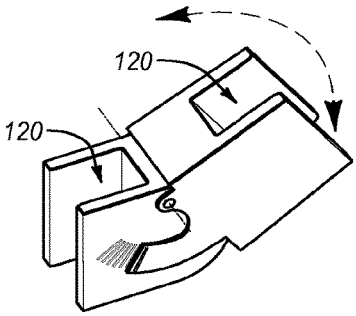
FIGS. 3P-3R are perspective views of various clips including two channels, each for engaging a thickness of a block, where an angle between the channels is adjustable (FIGS. 3P-3Q) or fixed (FIG. 3R)
Figure 3Q:
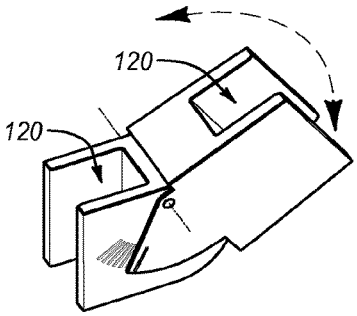
Figure 3R:
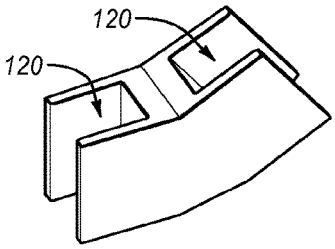

FIGS. 3P and 3Q show a clip configuration including two channels, and in which the angle between channels 120 may be selectively altered. For example, one may rotate one half of the clip relative to the other half about a hinge structure to select any desired angle (e.g., between about 0 and about 90°, between about 10° and about 80°, or between about 30° and about 60°). Any suitable hinge structure may be employed within such a clip (e.g., a pin hinge, a ball joint, etc.). The clip adjustment mechanisms may remain where positioned (e.g., include a locking feature) so as to prevent the selected angle from changing without the user making the adjustment. FIG. 3R illustrates another configuration including an angle between channels 120, but in which the angle is fixed, rather than adjustable. Any desired angle between 0 and 90° or within those ranges mentioned above may be provided. Such angled channel configurations may be particularly helpful for building the intersection of a wall with a roofline, or when building a truss or bridge structure.

Figure 3S:
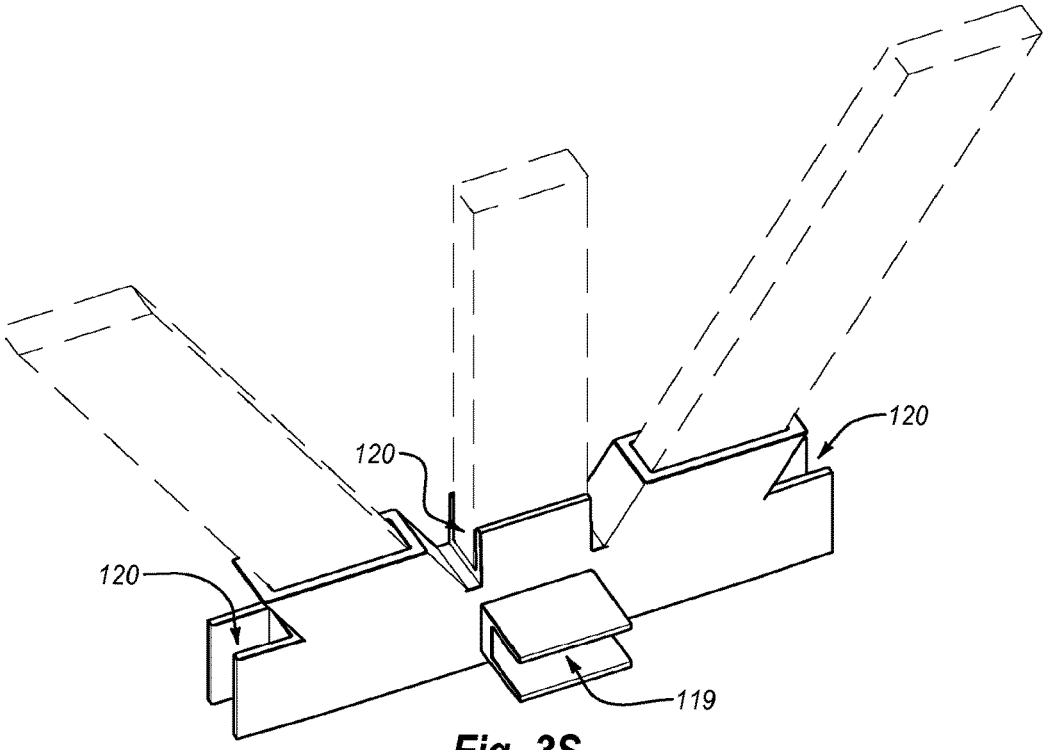
FIGS. 3S-3T are perspective views of additional various clips including multiple channels and/or sleeves for engaging blocks to form a truss-like structure.
Figure 3T:
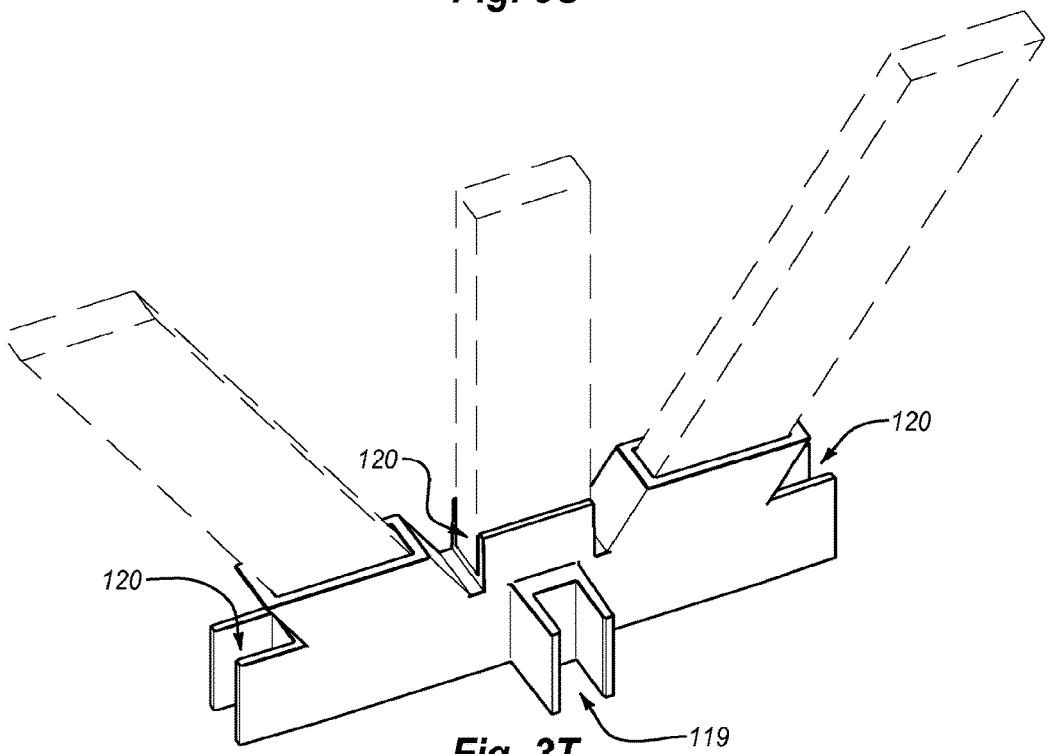

FIGS. 3S-3T show additional clip configurations, which clips include multiple channels and multiple sleeves or holes. The configuration shown in FIG. 3S shows a channel 119 oriented substantially transverse to channels 120. In other words, end channels 120 may be oriented vertically, while channel 119 may be oriented horizontally. Top, center channel 120 is rotated 90° relative to horizontal channel 120 "into the page". FIG. 3T shows a similar truss like clip configuration, but in which channel 119 is rotated to also be in a vertical orientation as channels 120. Clips or blocks for use in construction of a toy bridge may include a string or cable attached to the block or clip that can be strung between structure to resemble suspension cables. The various clip configurations are shown to describe some of the contemplated configurations. It will be understood that numerous other configurations are also possible, and are intended to be within the scope of the present invention.

In a broad context of one embodiment, the various clip configurations may include a pair of substantially parallel extensions configured to receive and frictionally retain a thickness of a block, while the clip further includes a magnet within a base (and/or even the extensions) of the clip in order to magnetically couple the magnet of the clip to another magnet, or to a magnetically attractable material (e.g., to a metal box top or other magnetically attractable pad that can act as a building base).

In one embodiment, the building set may be packaged within a metallic box, in which the box lid may be used as such a building base to providing magnetic coupling to the magnetic clips.

The clips may be formed of plastic or any other suitable material (e.g., plastic, wood, metal, carbon fiber, etc.). They may be formed by injection molding, machining, or other suitable technique. The magnet(s) within each clip are advantageously encased within the plastic or other material so as to prevent them from falling out or otherwise becoming dislodged. In one embodiment, the clips are not formed of wood to prevent such an issue (although perhaps a wooden clip could include a magnet encased therein in which an access hole used to place the magnet is back filled with glue, composite, epoxy, etc. Various techniques of inserting one or more magnets into a block are disclosed in U.S. Publication No. 2010/0242250, herein incorporated by reference. Such techniques could be adapted for providing a magnet within any clip according to the present invention. In addition, in one embodiment, one or more of the provided blocks may include a magnet encased therein, although in one embodiment, no magnets are provided within the blocks, rather the magnets are frictionally connected to the blocks through use of the clips. In one embodiment, the clips may be formed by bonding two halves about the magnet(s) (e.g., through sonic bonding).

Figure 4D:
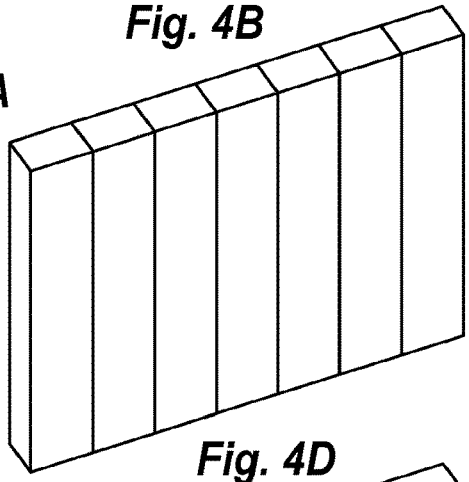
FIG. 4D is a perspective view of a block configured as a sheet (e.g., for a wall or roof)
Figure 4E:
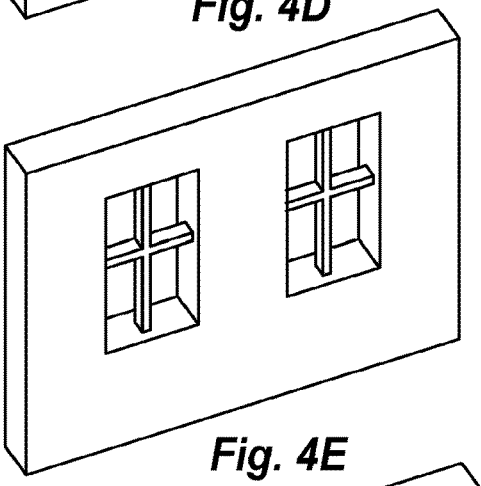
FIG. 4E is a perspective view of a sheet type block including windows.
Figure 4F:
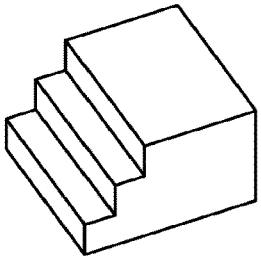
FIG. 4F is a perspective view of a stair type block.
Figure 4G:
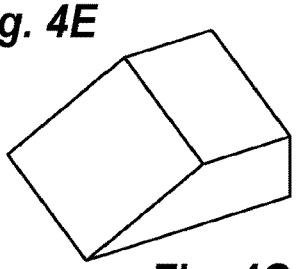
FIG. 4G is a perspective view of a ramp type block.

FIGS. 4A-4G illustrate various contemplated block configurations in addition to those shown in FIG. 1. FIG. 4A shows a cylindrical block, FIG. 4B a square cross-sectioned block, and FIG. 4C a specialty decorative block that may have various decorative patterns or shapes formed therein. FIG. 4D shows a block in the form of a relatively large sheet (e.g., with a thickness equal to that of the blocks of FIG. 1 but with significantly greater width dimensions (e.g., 3 times greater, 5 times greater, or 7 times greater). Such a sheet may be used as a wall or roof panel when building, and the thickness of the sheet may be engaged by the clips. FIG. 4E shows a sheet similar to that of FIG. 4D, but which includes windows formed therein. FIG. 4F shows a block in the shape of a set of stairs, while FIG. 4G shows a ramp. Any of such blocks may include a thickness (e.g., either face-to face, side to side, or end to end) that is engagable by a clip included within the building set. An attached photograph in the provisional application shows various additional block configurations. Another attached photograph of the provisional application shows how various plank, post, or beam elongate blocks may be frictionally engaged to clips, which in turn may be magnetically coupled to another clip to achieve various structural erector-like configurations simply not possible with existing magnetic block building sets.

In one embodiment, blocks may include any of various features incorporated therein. For example, the Figures show blocks shaped as stairs, walls, including windows, etc. Other configurations will also be apparent to one of skill in the art in light of the present disclosure. For example, a block may include a pulley incorporated into the block so that a width of the block may be engaged within a given clip, allowing the pulley (or other feature) to be indirectly coupled to the clip.

The blocks may be formed of any suitable material (wood, plastic, metal, carbon fiber, composite material, etc.). In one embodiment, the blocks are formed of wood or a plastic or composite material resembling wood.

Figure 5A:
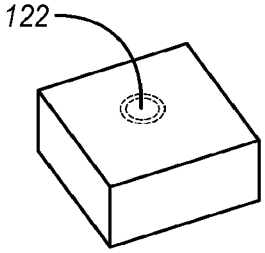
FIGS. 5A-5D are perspective views of a square, a triangular, a polygonal, and a circular magnetic intermediate structure for use in providing a desired orientation between respective adjacent clips with the intermediate structure therebetween (e.g., such as clips shown in FIG. 1 or any of the other figures)
Figure 5B:
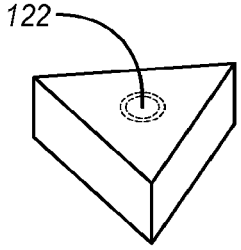
Figure 5C:
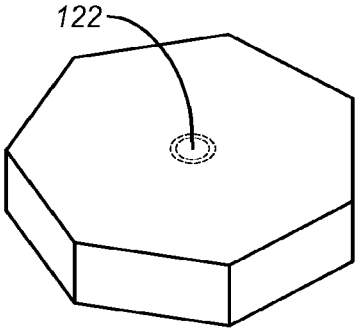
Figure 5D:
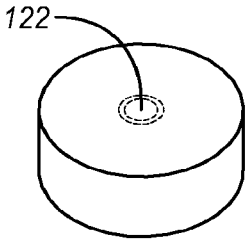

FIGS. 5A-5D shows intermediate structures for use in conjunction with the clips that also include a magnet disposed within the intermediate body, and which can be used with the magnetic clips in order to provide a desired orientation between the intermediate structure and two or more adjacent clips. For example, FIG. 5A shows a square or rectangular intermediate in which clips could be positioned (and magnetically coupled) along any of the 4 edges, or even the top or bottom surface of the intermediate structure. FIG. 5B shows a similar intermediate but including a 3-sided triangular configuration. FIG. 5C shows a polygonal intermediate structure including 7 sides, and FIG. 5D shows a circular configuration of an intermediate structure, which would allow clips to be positioned at any desired angle relative to one another (as opposed to a rectangular configuration as in FIG. 5A that is fixed at 90°, or a triangular configuration as in FIG. 5B fixed at 120°, or the configuration of FIG. 5C fixed at 51.4°). In one embodiment, one or more magnets may be disposed within the intermediate body at a location spaced apart from a center of the body, adjacent to a perimeter surface. For example, a rectangular intermediate body may include magnets positioned within the body adjacent to all 6 perimeter surfaces, while a triangular intermediate body may include magnets positioned within the body adjacent to all 3 perimeter surfaces. A circular intermediate body may include magnets location at various points inside of the circular body, relatively close to the perimeter exterior surface. In another embodiment, it may be possible to position a disc shaped or doughnut shaped magnet within the body to be adjacent to the entirety of the outer perimeter surfaces. Such intermediate structures may be formed of similar materials as described for the clips.

Another contemplated embodiment of a building set may include a plurality of elongate rods, or straight sided (e.g., square or rectangular) blocks or sticks that include a rounded bulb-shaped enlarged end (or such enlargements at two or more ends). Each rounded end would house a magnet enclosed within the bulb. The magnet within the enclosing bulb may be pivotable, like a ball joint to allow it to pivot as needed to correctly orient magnetic poles. Attached pictures illustrate the concept with q-tips including rubber cement at their enlarged rounded ends to simulate placement of such magnets. Such building structures could be connected in myriad ways because the enlarged tip (or at least the magnet housed therein) can rotate as much as about 360°. Sticks or rods of varying length could be provided, which can be magnetically coupled to one another. Such elongate rods could be used in conjunction with the previously described embodiments, or separately, without the need for clips to connect adjacent blocks.

Figure 6A:
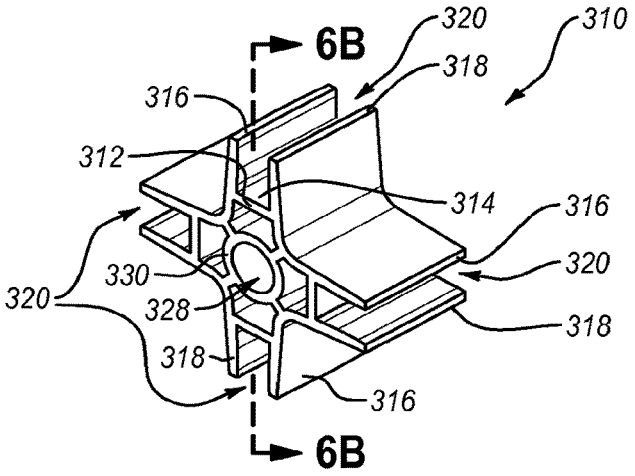
FIG. 6A is an isometric view of an alternative clip configuration including multiple channels.
Figure 6B:
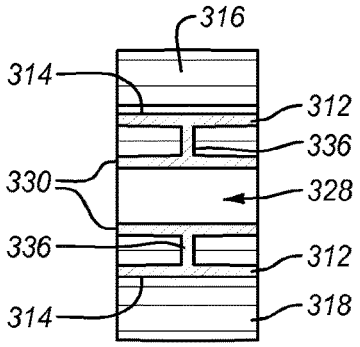
FIG. 6B is a cross-sectional view through the clip of FIG. 6A.
Figure 6C:
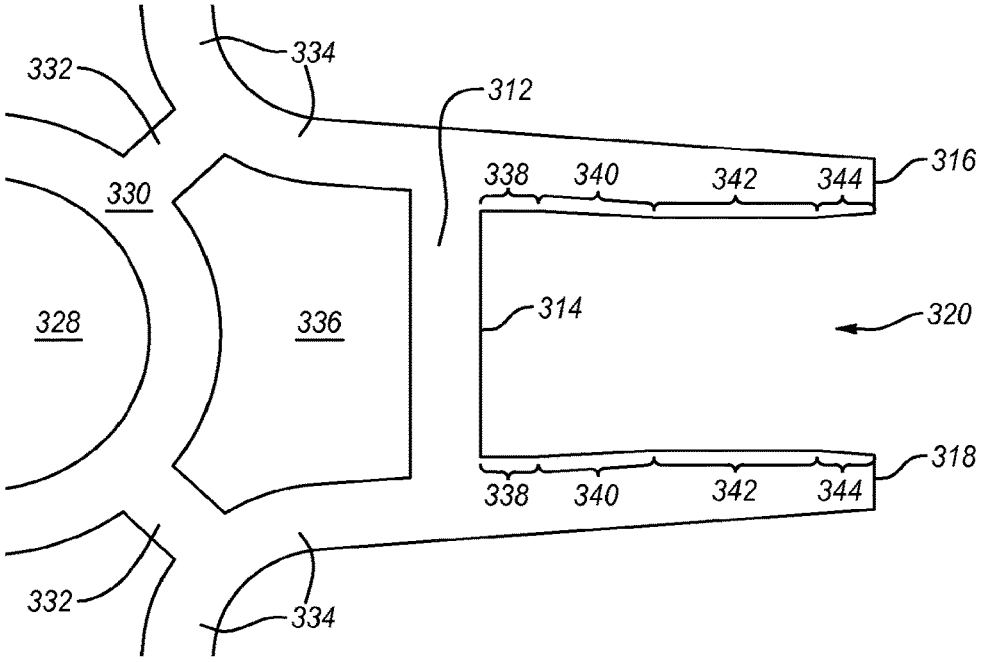
FIG. 6C is a close up plan view of a channel of the clip of FIG. 6A.
Figure 7:
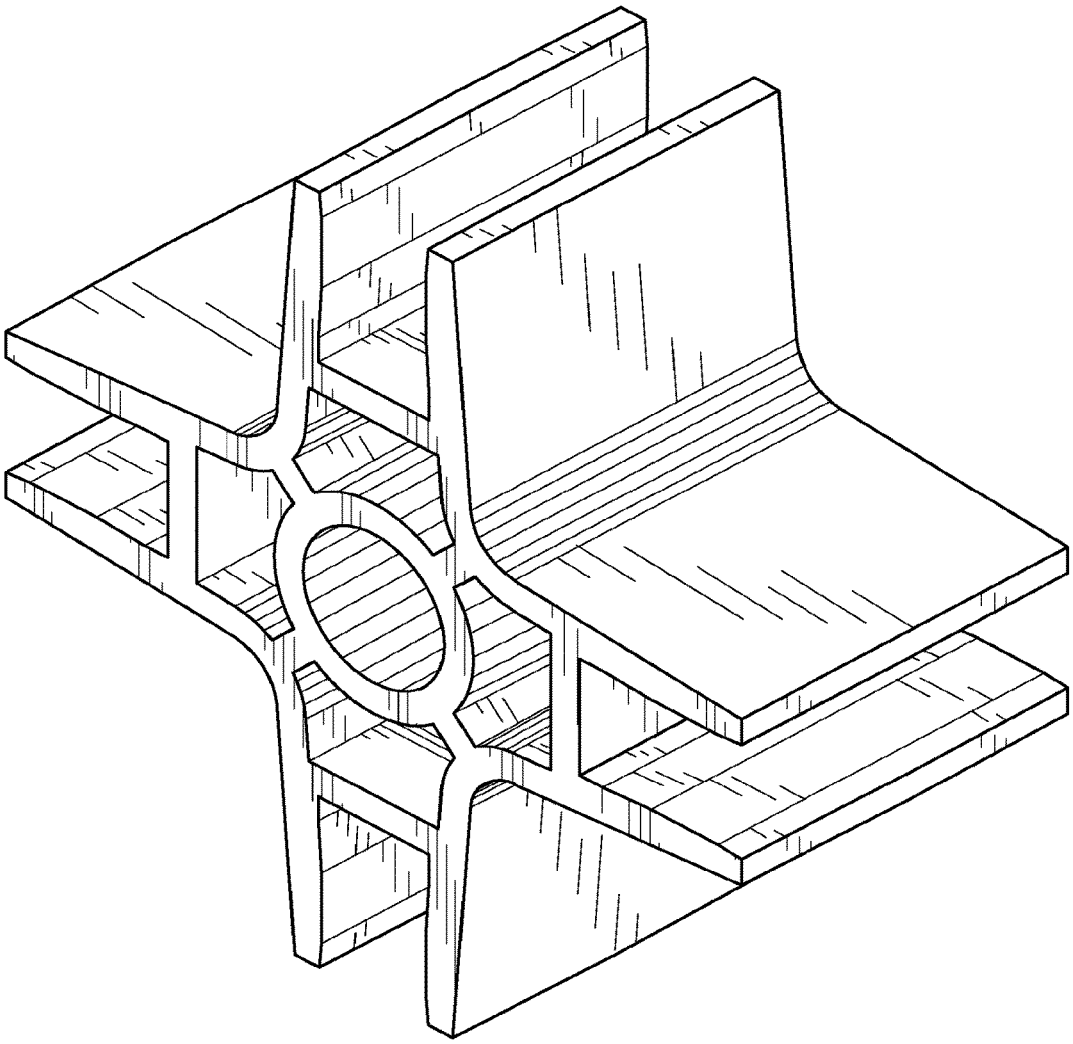
FIGS. 7-13 show a perspective view, a front view, a back view, a side view, an opposing side view, a top view, and a bottom view, respectively, of an ornamental design of a clip according to the present invention, similar to that shown in FIG. 6A.
Figure 8:
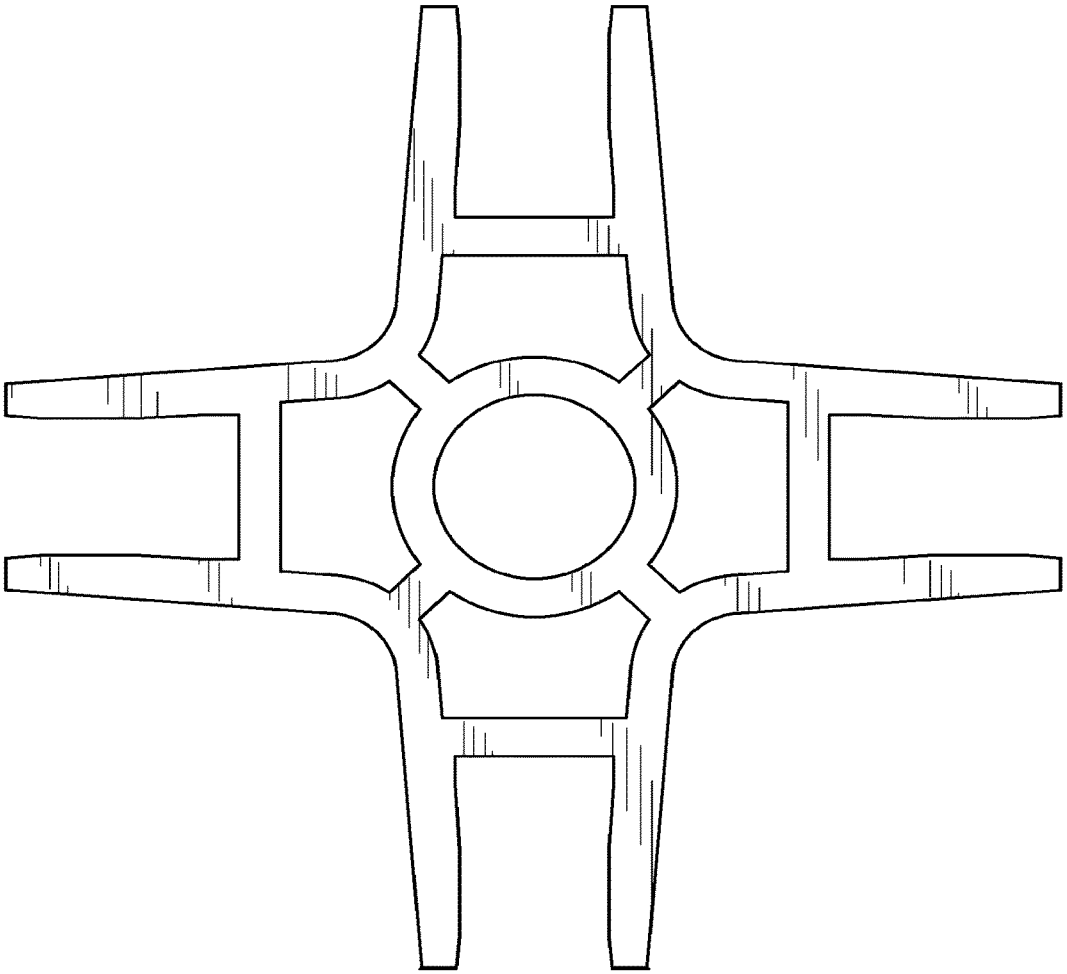
Figure 9:
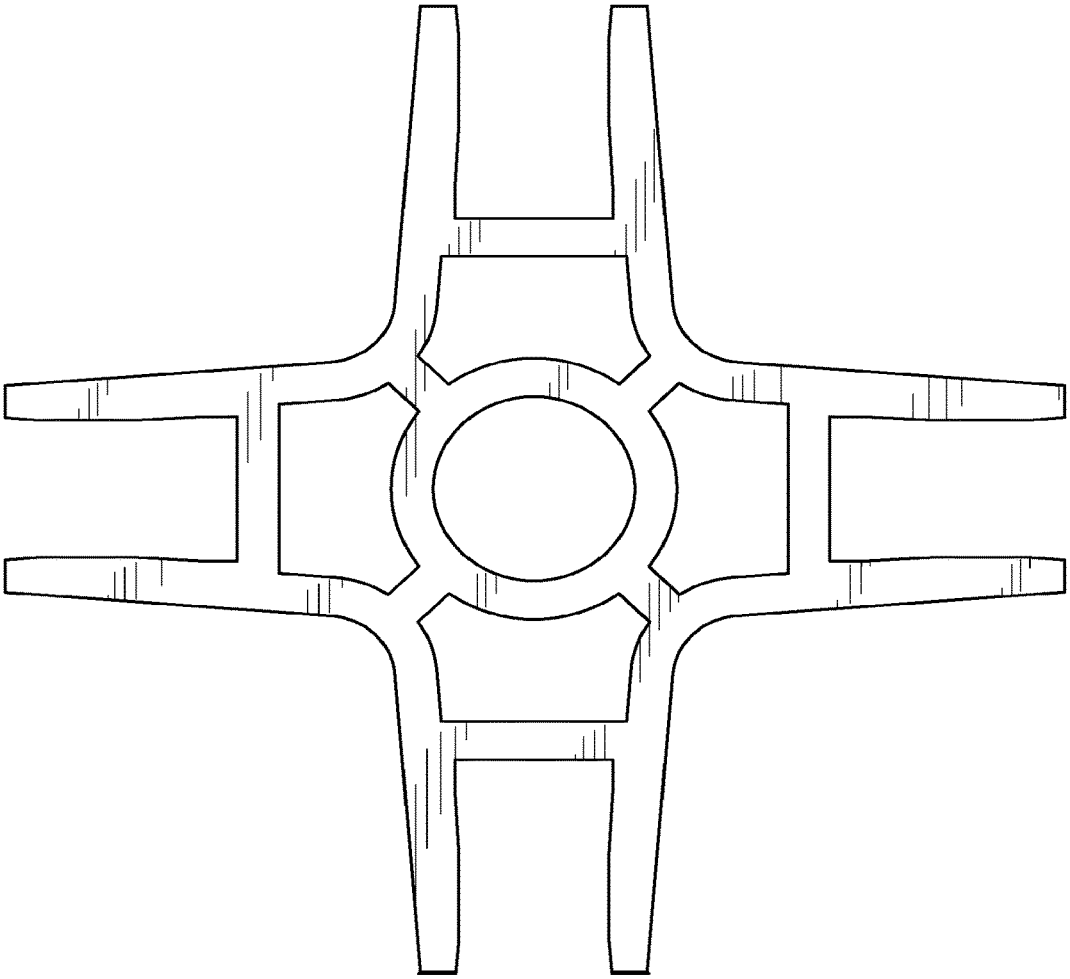
Figure 10:
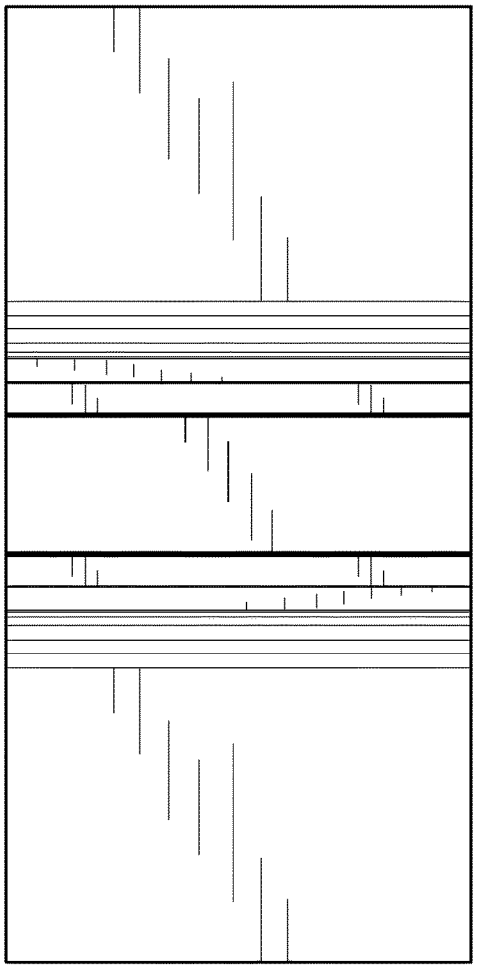
Figure 11:
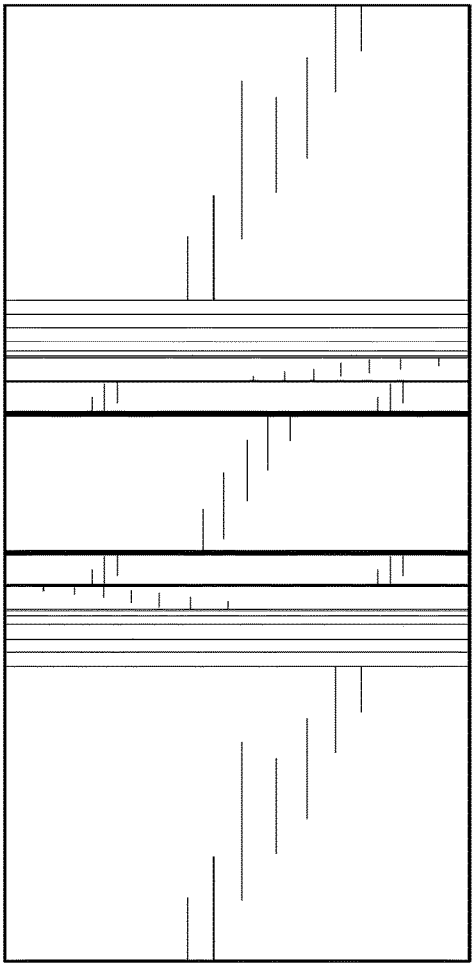
Figure 12:
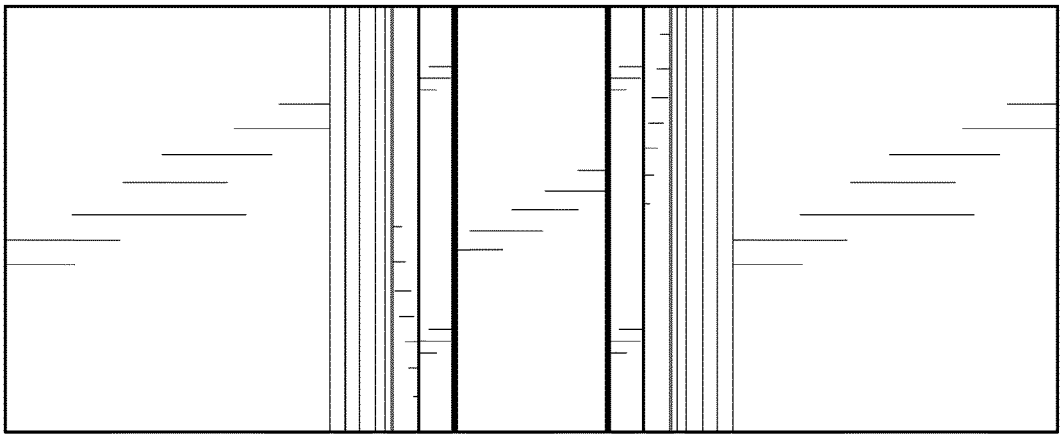
Figure 13:
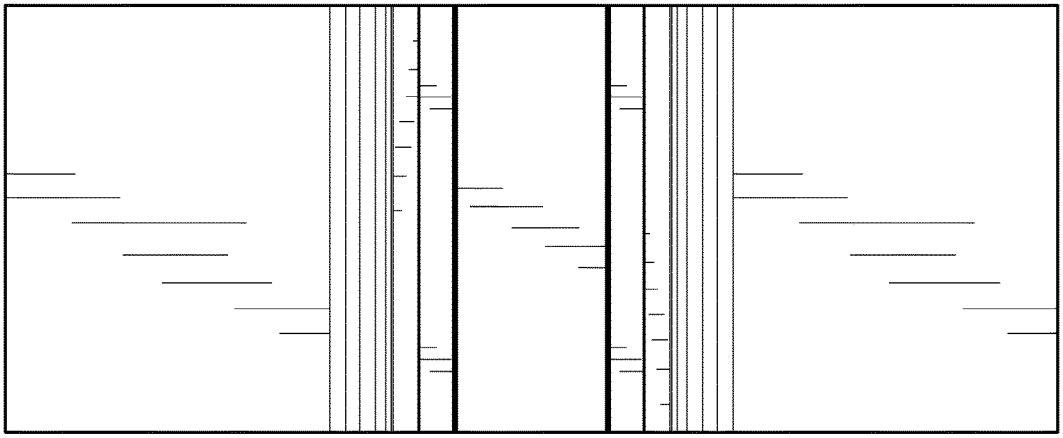

FIGS. 6A-6C show various views of an alternative clip configuration 310 that includes multiple planar u-shaped channels 320, each formed entirely of contiguous planar surfaces. Clip 310 may not include a magnet within the body, but rather includes multiple channels 320 that allows clip 310 to engage one or more blocks. Any of the above described clip configurations including multiple channels could similarly be manufactured without a magnet encased within the body.

Clip 310 includes a central body 330 and a plurality of u-shaped channels 320, where each of the u-shaped channels 320 is formed entirely of contiguous planar surfaces and disposed so as to extend from central body 330. Although four channels are illustrated, it will be understood that more or fewer channels may be provided (e.g., 2, 3, 5, 6, etc.). While each channel 320 is illustrated as being configured with equal width, it will be understood that one or more of the channels may have a different width than another of the channels. In addition, while all channels are shown to be oriented in a particular orientation, it will be understood that one or more of the channels may be differently oriented (e.g., transverse). For example, FIGS. 3O and 3S illustrate embodiments of clips in which channels are oriented transverse to one another.

Each channel 320 of clip 310 includes a base 312 disposed on central body 330. Each base 312 defines an interior planar floor surface 314 of each channel 320. The sides of each channel 320 are bounded by extensions 316 and 318, which are substantially parallel to each other. Each of extensions 316 and 318 forms a planar interior surface that extends outward from planar floor surface 314. The planar interior surfaces oppose one another and combine with planar floor surface 314 to form planar u-shaped channel 320 having a varying width. As described above, a thickness defined between opposed faces, sides, or ends of one or more blocks is receivable within any of channels 320. The width of channel 320 is substantially equal to the thickness of the corresponding block that is retainably engaged within a given channel.

As seen in FIGS. 6A-6B, a centrally disposed cylindrical hole 328 may be provided within central body 330. Hole 328 may be open at both ends (e.g., as a tunnel). A cylindrically configured block may be inserted within hole 328. For example, an axle for a wheeled vehicle as shown in the attached photograph with the provisional filing may be inserted through hole 328. Various other accessories (e.g., an anchor for a crane, hooks, pulleys, flags, windmill axles, etc.) may similarly be provided in this way.

Central body 330 and channels 320 may advantageously be configured to provide independence between the plurality of included channels. For example, insertion of a block into one channel does not substantially interfere with the ability of another channel of the clip 310 to retain a block with substantially the same retention force that would be provided if only a single channel had a block received therein. Some similar toy coupler configurations within the prior art suffer from lack of independence between individual coupling mechanisms of the device. For example, when a second block or piece is inserted within a second coupler mechanism, it may cause a first already inserted block or piece to fall out or be retained with a substantially reduced retention force (i.e., so that it may easily fall out if bumped or jarred). The ability to provide independence to each channel is particularly advantageous, as it allows any or all of the channels to be employed without risk that the structure will become unstable as a result of weakened retention force for the frictionally engaging channels.

Independence is provided through a combination of features of the central body, the channels themselves, and the material from which the clip is formed. For example, the clip may be injection molded from a relatively rigid plastic material such as polycarbonate. Rigidity of the material from which the clip is formed aids in providing the desired independence. Furthermore, the central body 330 may include a plurality of stabilizing ribs 332 extending outwardly from the cylindrical wall bounding central hole 328 towards a portion 334 of extensions 316 and 318 that extend beyond base 312. The clip may include ribs that are substantially equally spaced between channels 320, so that the clip includes an equal number of ribs 332 and channels 320. Ribs 332 aid in preventing stresses and forces applied to extensions 316 and 318 from being transferred from one channel to the extensions of another channel of clip 310 when a block is retained within a given channel 320.

Central body 330 may further include a plurality of flanges 336 centrally disposed between base 312 of channel 320, portions 334 of extensions 316 and 318, ribs 332, and the cylindrical wall of hole 328. The flange 336 may fill the area of space shown in FIG. 6C between these structures, without filling the entire depth of the clip, as reflected in FIGS. 6A and 6B. For example, flange 336 may have a thickness approximately equal to that of extensions 316, 318, base 312, cylindrical wall defining hole 328, or ribs 332 (e.g., as shown in FIG. 6B)

FIG. 6C shows a close up plan view of one of planar u-shaped channels 320 extending from body 330, perhaps best showing the details of extensions 316 and 318. As shown in FIG. 6C, at least a portion of the planar interior surface of each extension 316, 318 defines an angle relative to floor 314 that is less than 90° so that extensions "pinch" the thickness of a block received within a given channel 320, frictionally coupling the clip 310 to a block received within extensions 316, 318 of a respective channel 320. As shown in FIG. 6C, the planar interior surface of each extension 316, 318 may include four distinct portions. A first portion 338 is disposed adjacent to floor 314, and is formed perpendicular (i.e., 90°) relative to floor 314. A second portion 340 between the first portion 338 and a third portion 342 provides an angle relative to floor 314 that is less than 90°. For example, the angle between portion 340 and floor 314 may be from about 85° to less than 90°, or from 86° to 88° (e.g., 87°). A third portion 342 between second portion 340 and a fourth distal portion 344 may be formed so as to be perpendicular relative to floor 314. Fourth distal portion 344 may be formed to be outwardly flared so as to provide an angle relative to floor 314 that is more than 90°. For example, the angle between portion 344 and floor 314 may be from 92° and 98° (e.g., 95°).

Depending on the tolerances achieved during manufacture, the four distinct differently angled surfaces may be somewhat muddled as a result of shrinkage of the plastic or other material during manufacture or other reasons. For example, a finished manufactured product may be readily observed to include at least two portions. For example, a proximal portion (e.g., corresponding to portions 338 and 340) may overall provide an angle relative to the floor that is less than 90°, while a more distal portion (e.g., corresponding to portion 342 and perhaps 344) provides an angle relative to floor 314 that is at least 90°.

The width of channel 320 may thus vary somewhat according to location within the channel 320. For example, the width of channel 320 adjacent floor 314 may measure somewhat larger than the thickness of a block to be engaged within channel 320. Channel width may progressively narrower through the portion of channel 320 corresponding to portion 340 (as portions 340 on each side of channel 320 are "pinch" angled). The width of channel 320 corresponding to distal portion 344 may quickly be somewhat larger (as a result of its outward flare) than the thickness of the block (e.g., similar to portion 338). As a result, substantially all of the frictionally engaging retention force for retaining a block within channel 320 may be provided along portion 342.

In one embodiment, portion 342 may account for about 35% to about 45% (e.g., about 40%) of the depth of channel 320. In one embodiment, the channel may have a length that is substantially equal to a dimension of a corresponding dimension of one or more of the blocks (e.g., about 23 mm). Width of channel 320 along corresponding to portions 338 may measure 0.310 inch, while the width at the opening of channel corresponding to portions 344 may measure 0.294 inch. For example, the width may narrow by about 1% to about 10% over the channel width (e.g., about 5%).

In addition to providing independence between the various channels of the clip 310, the retaining force provided by each channel and a given block is preferably relatively strong, so as to prevent a block from falling out of a channel inadvertently. Of course, the retaining force provided requires that the dimension of the block to be retained be sized for use with the friction retaining channel. Where the dimensions are approximately equal, so that the block is frictionally retained within channel 320, the features described above (e.g., pinching configuration of the interior surfaces of channel 320, structural ribs 332 and flanges 336, selection of a rigid plastic such as polycarbonate) provide a retaining force so that from about 1 lb to about 5 lbs of pull out force is required to pull a block that engages substantially all of the length of the channel out of the channel. In other words, where the block is sized smaller than the channel length, or only half or a portion of the block dimension is engaged within the channel, the actual retention force will be less for that particular configuration, although the retaining force available when the channel length is fully engaged will be 1 lb to about 5 lbs. In another embodiment, the provided retaining force is from about 2 lbs to about 4 lbs of pull out force to pull the block out of the channel.

In testing the pull out force, 6 blocks of approximately equal size and shape (as shown in the photograph of the wheeled vehicle in the provisional application) fully inserted within the illustrated clips and were pulled out. A fish scale was used to measure the weight or force required to achieve pull out. The results as shown in Table 1 below.

TABLE 1

| Block | First Try (lbs) | Second Try (lbs) | Third Try (lbs) | Average (lbs) |
|---|---|---|---|---|
| 1 | 3.5 | 3.2 | 3.0 | 3.2 |
| 2 | 3.1 | 3.3 | 3.2 | 3.2 |
| 3 | 4.0 | 3.5 | 4.0 | 3.8 |
| 4 | 2 | 2 | 2 | 2 |
| 5 | 3.5 | 3.5 | 3.2 | 3.4 |
| 6 | 2.5 | 2.7 | 2.5 | 2.6 |

It was observed that although the blocks were all approximately equally sized 8 mm×23 mm×118 mm, minor variances within the block dimension engaging the channel (i.e., 8 mm) have an effect on the retention force. For example, block 4 was observed to be somewhat thinner than the nominal 8 mm dimension, resulting in its lower retention values. Still, the retention value of 2 lbs will typically be sufficient for contemplated use. The particular configuration described in conjunction with FIGS. 6A-6C provides a retention force with the contemplated blocks that allows for self-supporting, large structures while allowing a young child (e.g., even a 3 or 5 year old) to connect them together without difficulty. Furthermore, independent retention of the blocks so that one engaged block does not substantially affect the retention force of the other engaged blocks is particularly beneficial.

It must be noted that, as used in this specification and the appended claims, the singular forms "a," "an" and "the" include plural referents unless the context clearly dictates otherwise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A toy clip for frictionally engaging a thickness of one or more building blocks, the clip comprising:

a planar u-shaped receiver formed entirely of contiguous planar surfaces, the planar u-shaped receiver including:

at least a base defining a planar floor surface; and a pair of extensions extending from the base to a pair of lateral edges, the extensions each forming a planar interior surface, wherein the planar floor surface and the planar interior surfaces of the extensions combine to define a channel having a proximal portion adjacent to the planar floor surface and a distal portion adjacent to the lateral edges, the channel having a variable width according to a location along or between the proximal portion and the distal portion, the variable width of the channel configured to retain the thickness of at least one of the building blocks via only a frictional fit.

2. The toy clip of claim 1, wherein the variable width of the channel is defined by one or more discontinuities along the planar interior surfaces of the extensions.

3. The toy clip of claim 2, wherein the one or more of the discontinuities along the planar interior surfaces of the extensions comprise frictional features along the planar interior surfaces of the extensions.

4. The toy clip of claim 3, wherein the frictional features along the planar interior surfaces of the extensions are formed by differing angles between the planar interior surfaces and the planar floor surface at the proximal and the distal portions of the channel.

5. The toy clip of claim 4, wherein the proximal portion and the distal portion combine to form a first portion adjacent to the planar floor surface, a second portion adjacent to the first portion, a third portion adjacent to the second portion, and a fourth portion between the third portion and the lateral edges.

6. The toy clip of claim 5, wherein the channel has respective first, second, third, and fourth widths at the first, the second, the third, and the fourth portions of the channel.

7. The toy clip of claim 6, wherein the planar interior surfaces of the extensions form respective first, second, third, and fourth angles relative to the planar floor surface at the first, the second, the third, and the fourth portions of the channel.

8. The toy clip of claim 7, wherein the first angle is approximately 90 degrees, the second angle is less than 90 degrees, the third angle is approximately 90 degrees, and the fourth angle is greater than 90 degrees.

9. The toy clip of claim 1, wherein the extensions extend outward from the base to the lateral edges.

10. The toy clip of claim 1, wherein:

the base is disposed about a central body;

one or more additional bases are disposed about the central body; and an additional pair of extensions extend from each of the additional bases to form one or more additional channels about the central body.

11. A toy clip for engaging one or more building blocks, comprising:

a number of planar u-shaped channels disposed about a central body, each of the channels formed entirely of contiguous planar surfaces and defined by a base forming a planar floor surface and by respective first and second extensions that form first and second planar interior surfaces extending outward from the planar floor surface to first and second lateral edges, wherein:

a width separates the first and the second planar interior surfaces, the width configured for frictional retention of one or more of the building blocks; and the width separating the first and the second planar interior surfaces varies according to a location between the planar floor surface and the first and the second lateral edges.

12. The toy clip of claim 11, wherein one or more elevation discontinuities along at least one of the first and the second planar interior surfaces cause the width separating the first and the second planar interior surfaces to vary according to the location between the planar floor surface and the first and the second lateral edges of the channel.

13. The toy clip of claim 12, wherein the one or more of the elevation discontinuities form a pinch point in the width separating the first and the second planar interior surfaces of the first and the second extensions.

14. The toy clip of claim 13, wherein the one or more of the elevation discontinuities comprise one or more frictional protrusions that extend toward a center of the channel.

15. The toy clip of claim 14, wherein:

the channel comprises a first portion adjacent to the planar floor surface, a second portion adjacent to the first portion, a third portion adjacent to the second portion, and a fourth portion between the third portion and the first and the second lateral edges;

the first and the second planar interior surfaces at the first portion are formed perpendicular to the planar floor surface;

the first and the second planar interior surfaces at the second portion are formed at an inward angle of less than 90 degrees;

the first and the second planar interior surfaces at the third portion are formed perpendicular to the planar floor surface;

the first and the second planar interior surfaces at the fourth portion are formed at an outward angle greater than 90 degrees;

each of the first and the second planar interior surfaces defines a first intersection where the second portion meets the third portion and a second intersection where the third portion meets the fourth portion; and the first and the second intersections define the one or more of the frictional protrusions.

16. A connecting joint for a toy building set, consisting of:

a toy building block having a fixed thickness; and a toy clip defining a planar u-shaped channel formed entirely of contiguous planar surfaces, the planar u-shaped channel defined by a base forming a planar floor surface and respective first and second extensions that extend outward from the base to first and second lateral edges, the first and the second extensions having first and second planar interior surfaces, the planar u-shaped channel having a varying width that is configured to engage the toy building block via a frictional fit.

17. The connecting joint of claim 16, wherein:

the varying width of the channel comprises at least one pinch point along the first and the second planar interior surfaces of the first and the second extensions.

18. The connecting joint of claim 17, wherein the at least one pinch point comprises an elevation discontinuity along at least one of the first and the second planar interior surfaces.

19. The connecting joint of claim 18, wherein the elevation discontinuity comprises a frictional protrusion formed along the at least one of the first and the second planar interior surfaces.

20. The connecting joint of claim 19, wherein the channel is disposed about a central body of the toy clip.

* * * * *